US010351933B2

(12) United States Patent
Uchida

(10) Patent No.: US 10,351,933 B2
(45) Date of Patent: Jul. 16, 2019

(54) BRASS WITH EXCELLENT CORROSION RESISTANCE

(71) Applicant: TOTO LTD., Kitakyushu-Shi, Fukuoka (JP)

(72) Inventor: Toru Uchida, Fukuoka-Ken (JP)

(73) Assignee: Toto Ltd., Fukuoka (JP)

( * ) Notice: Subject to any disclaimer, the term of this patent is extended or adjusted under 35 U.S.C. 154(b) by 988 days.

(21) Appl. No.: 14/346,620

(22) PCT Filed: Feb. 1, 2013

(86) PCT No.: PCT/JP2013/052354

§ 371 (c)(1),
(2) Date: Mar. 21, 2014

(87) PCT Pub. No.: WO2013/115363

PCT Pub. Date: Aug. 8, 2013

(65) Prior Publication Data

US 2014/0234156 A1 Aug. 21, 2014

(30) Foreign Application Priority Data

Feb. 1, 2012 (JP) ..... 2012-019614

(51) Int. Cl.
*C22C 1/02* (2006.01)
*C22C 1/03* (2006.01)
*C22C 9/04* (2006.01)

(52) U.S. Cl.
CPC ..... *C22C 9/04* (2013.01); *C22C 1/02* (2013.01); *C22C 1/03* (2013.01)

(58) Field of Classification Search
CPC .... C22C 9/00; C22C 9/04; C22C 1/02; C22C 1/03
See application file for complete search history.

(56) References Cited

U.S. PATENT DOCUMENTS 8,968,492 B2 * 3/2015 Uchida ..... B22C 9/22 148/432
2002/0015657 A1 2/2002 Dong
2003/0095887 A1 5/2003 Dong
2004/0159375 A1 8/2004 Yamagishi
2009/0263272 A1 * 10/2009 Uchida ..... C22C 9/04 420/471
2016/0215366 A1 * 7/2016 Uchida ..... C22C 9/04

FOREIGN PATENT DOCUMENTS

| | | | |
|---|---|---|---|
| JP | S59-19639 | A | 2/1984 |
| JP | S60-200933 | A | 10/1985 |
| JP | S61-542 | A | 1/1986 |
| JP | S62-30861 | A | 2/1987 |
| JP | S62-30862 | A | 2/1987 |
| JP | H09-143598 | A | 6/1997 |
| JP | H09-176762 | A | 7/1997 |
| JP | 2002012927 | A | 1/2002 |
| JP | 2010-242184 | A | 10/2010 |
| JP | 2011-021273 | A | 2/2011 |

OTHER PUBLICATIONS

To Jushin, JP 2002-012927. Machine translation. (Year: 2002).*
Brief Communication dated Jan. 16, 2019, issued in corresponding European Patent Application No. 13742899.1.
Li et al., "The Effect of Boron on Corrosion Resistance of 70/30 Brass", Journal of Chinese Society of Corrosion and Protection, Dec. 1990, vol. 10, No. 4.

* cited by examiner

*Primary Examiner* — Keith Walker
*Assistant Examiner* — John A Hevey
(74) *Attorney, Agent, or Firm* — Carrier Blackman & Associates, P.C.; Joseph P. Carrier; Anne G. Sabourin

(57) ABSTRACT

Disclosed is a brass that possesses high corrosion resistance even without undergoing a heat treatment step contemplated for dezincification corrosion suppression. This brass includes 55% by mass to 75% by mass of Cu (copper), 0.01% by mass to 1.5% by mass of Si (silicon), Sn (tin) and Al (aluminum) in such amounts as to satisfy a prescribed relationship with an apparent Zn content, less than 0.25% by mass of Mn (manganese) as an optional ingredient, less than 0.05% by mass of Ti (titanium) as an optional ingredient, less than 0.3% by mass of Mg (magnesium) as an optional ingredient, less than 0.15% by mass of P (phosphorus) as an optional ingredient, and less than 0.004% by mass of a rare earth metal as an optional ingredient with the balance consisting of Zn (zinc) and unavoidable impurities, the apparent zinc content being 37 to 45.

10 Claims, No Drawings

BRASS WITH EXCELLENT CORROSION RESISTANCE

TECHNICAL FIELD

The present invention relates to a highly corrosion-resistant brass, and more specifically, the present invention relates to a highly corrosion-resistant brass that can eliminate the need to provide a heat treatment step for dezincification corrosion suppression purposes.

BACKGROUND ART

Brass, a copper-zinc-base alloy, possesses excellent workability, strength, and corrosion resistance and thus is used in various applications. Under some use conditions, however, dezincification corrosion sometimes occurs in which zinc, a constituent element of the alloy, is eluted prior to copper and other ingredients. This tendency increases with an increase in zinc content. It is known that, in brass including copper and zinc at a copper:zinc content ratio of about 60:40, a two-phase structure of α phase and zinc-rich β phase is formed and dezincification corrosion selectively occurs in the β phase.

As means for preventing dezincification corrosion, Sn (tin), P (phosphorus) and the like are added and heat treatment is carried out. Alloys of which corrosion resistance has been improved by this method, i.e., by removing the β phase from the two-phase structure after casting or hot working to form a single-phase structure of an α phase, or by minimizing the proportion of the β phase are placed on the market as a dezincification-resistant brass.

However, the heat treatment for obtaining the dezincification-resistant brass is a complicated heat treatment step, and the brass obtained by this process the cost which is higher than that of ordinary brass. Further, when the dezincification-resistant brass is cast or forged, heat treatment should be carried out after the working, resulting in significantly lowered productivity.

CITATION LIST

Patent Literature

[PTL 1] 2011-179121A (Example 12)

[PTL 2] 2011-219857A (Example)

[PTL 3] 2002-349574A (Example 16)

[PTL 4] 2010-133006A (Examples 3, 5, 7, 8, and 13)

[PTL 5] 2010-242184A (Examples 10, 13 to 39, and 42 to 51)

SUMMARY OF THE INVENTION

The present inventors have now found that prescribing Sn (tin) and Al (aluminum) and the apparent zinc content to a specific ratio can realize highly corrosion-resistant brass with suppressed dezincification corrosion without undergoing the heat treatment step. Further, it has been found that the addition of a very small amount of Si (silicon) can realize a brass having good properties, especially good castability. The present invention has been made based on such finding.

Accordingly, an object of the present invention is to provide a highly corrosion-resistant brass that can eliminate the need to undergo a heat treatment step for dezincification corrosion suppression purposes.

According to one aspect of the present invention, there is provided a brass comprising:

Cu: not less than 55% by mass to not more than 75% by mass,

Si: not less than 0.01% by mass to not more than 1.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, the brass having an apparent Zn content of not less than 37 and not more than 45, wherein (I) when the content of Si is not less than 0.01% by mass and not more than 0.1% by mass, (1) the apparent Zn content is not less than 37 and less than 39 and the following relationship is satisfied:

$$0.1 \le x \le 0.2 \text{ and } 0.1 < y \le 2.0 \text{ or} \quad (1\text{-}1)$$

$$0.2 < x \le 3.0 \text{ and } 0.1 \le y \le 2.0 \quad (1\text{-}2)$$

wherein x represents the content of Sn, by mass; and y represents the content of Al, % by mass, (2) the apparent Zn content is not less than 39 and less than 43 and the following relationship is satisfied:

$$0.1 < x \le 0.2 \text{ and } -4x+0.9 < y \le 2.0 \text{ or} \quad (2\text{-}1)$$

$$0.2 < x \le 3.0 \text{ and } 0.1 \le y \le 2.0 \quad (2\text{-}2)$$

wherein x represents the content of Sn, % by mass; and y represents the content of Al, % by mass, and (3) the apparent Zn content is not less than 43 and not more than 45 and the following relationship is satisfied:

$$0.1 \le x \le 0.2 \text{ and } 0.5 < y \le 2.0, \quad (3\text{-}1)$$

$$0.2 < x \le 0.3 \text{ and } -4x+1.3 < y \le 2.0, \text{ or} \quad (3\text{-}2)$$

$$0.3 < x \le 3.0 \text{ and } 0.1 \le y \le 2.0 \quad (3\text{-}3)$$

wherein x represents the content of Sn, % by mass; and y represents the content of Al, % by mass, (II) when the content of Si is more than 0.1% by mass and not more than 0.5% by mass, (4) the apparent Zn content is not less than 37 and less than 39 and the following relationship is satisfied:

$$0.1 \le x \le 0.2 \text{ and } -5x+1.5 < y \le 2.0 \text{ or} \quad (4\text{-}1)$$

$$0.2 < x \le 3.0 \text{ and } 0.1 \le y \le 2.0 \quad (4\text{-}2)$$

wherein x represents the content of Sn, by mass; and y represents the content of Al, % by mass, (5) the apparent Zn content is not less than 39 to less than 41 and the following relationship is satisfied:

$$0.1 < x \le 0.2 \text{ and } -5x+1.5 < y \le 2.0 \text{ or} \quad (5\text{-}1)$$

$$0.2 < x \le 3.0 \text{ and } 0.1 \le y \le 2.0 \quad (5\text{-}2)$$

wherein x represents the content of Sn, by mass; and y represents the content of Al, % by mass, (6) the apparent Zn content is not less than 41 to less than 43 and the following relationship is satisfied:

$$0.1 < x \le 0.2 \text{ and } -5x+2.5 < y \le 2.0, \quad (6\text{-}1)$$

$$0.2 < x \le 0.3 \text{ and } -4x+1.3 < y \le 2.0, \quad (6\text{-}2)$$

$0.3<x\leq0.4$ and $0.1<y\leq2.0$ or (6-3)

$0.3<x\leq0.4$ and $0.1\leq y\leq2.0$ (6-4)

wherein x represents the content of Sn, % by mass; and y represents the content of Al, % by mass, and (7) the apparent Zn content is not less than 43 and not more than 45 and the following relationship is satisfied:

$0.3<x\leq0.4$ and $-5x+2.5<y\leq2.0$, (7-1)

$0.4<x\leq0.5$ and $-4x+2.1<y\leq2.0$ or (7-2)

$0.5<x\leq3.0$ and $0.1\leq y\leq2.0$ (7-3)

wherein x represents the content of Sn, % by mass; and y represents the content of Al, % by mass, (III) when the content of Si is more than 0.5% by mass and not more than 1.0% by mass, (8) the apparent Zn content is not less than 37 and less than 39 and the following relationship is satisfied:

$0.1<x\leq0.2$ and $-4x+0.9<y\leq2.0$ or (8-1)

$0.2<x\leq3.0$ and $0.1\leq y\leq2.0$ (8-2)

wherein x represents the content of Sn, % by mass; and y represents the content of Al, % by mass, (9) the apparent Zn content is not less than 39 and less than 41 and the following relationship is satisfied:

$0.1<x\leq0.2$ and $-5x+2.0<y\leq2.0$, (9-1)

$0.2<x\leq0.3$ and $-4x+1.3<y\leq2.0$, (9-2)

$0.3<x\leq0.4$ and $0.1<y\leq2.0$ or (9-3)

$0.4<x\leq3.0$ and $0.1\leq y\leq2.0$ (9-4)

wherein x represents the content of Sn, by mass; and y represents the content of Al, % by mass,

(10) the apparent Zn content is not less than 41 and less than 43 and the following relationship is satisfied:

$0.2<x\leq0.3$ and $-5x+2.5<y\leq2.0$, (10-1)

$0.3<x\leq0.4$ and $-4x+1.7\leq y\leq2.0$ or (10-2)

$0.4<x\leq3.0$ and $0.1\leq y\leq2.0$ (10-3)

wherein x represents the content of Sn, % by mass; and y represents the content of Al, % by mass, and

(11) the apparent Zn content is not less than 43 and not more than 45 and the following relationship is satisfied:

$0.3<x\leq0.4$ and $-5x+3.0<y\leq2.0$ or (11-1)

$0.4<x\leq3.0$ and $0.1\leq y\leq2.0$ (11-2)

wherein x represents the content of Sn, % by mass; and y represents the content of Al, % by mass, and (IV) when the content of Si is more than 1.0% by mass and not more than 1.5% by mass,

(12) the apparent Zn content is not less than 37 and less than 39 and the following relationship is satisfied:

$0.1\leq x\leq0.2$ and $-4x+0.9<y\leq2.0$, (12-1)

$0.2<x\leq0.3$ and $0.1<y\leq2.0$ or (12-2)

$0.3<x\leq3.0$ and $0.1\leq y\leq2.0$ (12-3)

wherein x represents the content of Sn, % by mass; and y represents the content of Al, % by mass,

(13) the apparent Zn content is not less than 39 and less than 41 and the following relationship is satisfied:

$0.1<x\leq0.2$ and $-5x+2.0<y\leq2.0$, (13-1)

$0.2<x\leq0.3$ and $1.0<y\leq2.0$ or (13-2)

$0.3<x\leq3.0$ and $0.1<y\leq2.0$ (13-3)

wherein x represents the content of Sn, by mass; and y represents the content of Al, % by mass,

(14) the apparent Zn content is not less than 41 and less than 43 and the following relationship is satisfied:

$0.4<x\leq0.5$ and $-5x+3.0<y\leq2.0$ or (14-1)

$0.5<x\leq3.0$ and $0.1\leq y\leq2.0$ (14-2)

wherein x represents the content of Sn, % by mass; and y represents the content of Al, % by mass, and

(15) the apparent Zn content is not less than 43 and not more than 45, the following relationship is satisfied:

$0.2<x\leq0.3$ and $-5x+2.5<y\leq2.0$, (15-1)

$0.3<x\leq0.4$ and $-4x+1.7<y\leq2.0$ or (15-2)

$0.4<x\leq3.0$ and $0.1\leq y\leq2.0$ (15-3)

wherein x represents the content of Sn, % by mass; and y represents the content of Al, % by mass.

The present invention can provide a highly corrosion-resistant brass without the need to undergo a heat treatment step that significantly affects the cost and productivity of dezincification-resistant brass. Further, the present invention can provide a castable highly corrosion-resistant brass material that can eliminate the need to undergo a heat treatment step.

DESCRIPTION OF EMBODIMENTS

Definitions

Apparent Zinc Content

The apparent zinc content is a content calculated by the following equation proposed by Guillet. This equation is based on such a way of thinking that additive elements other than Zn exhibit the same tendency as the addition of Zn.

$$\text{Apparent zinc content (\%)}=[(B+tq)/(A+B+tq)]\times100$$

wherein A represents the content of Cu, %, by mass; B represents the content of Zn, % by mass; t represents zinc equivalent of additive element; and q represents the addition amount of additive element, % by mass. The zinc equivalent for each element is Si=10, Al=6, Sn=2, Pb=1, Fe=0.9, Mn=0.5, Ni=−1.3, Mg=2, and Cd=1. The zinc equivalent of Bi (bismuth) has not been specified yet. In the present specification, however, the zinc equivalent of Bi is regarded as 0.6 for calculation based on data in literature and the like. The zinc equivalent of other elements is regarded as "1" because the addition amount is very small and the influence on the apparent zinc content is also small.

In the present invention, "unavoidable impurities" means elements contained in an amount of less than 0.1% by weight, unless otherwise specified. Mn (manganese), Ti (titanium), Mg (magnesium), P (phosphorus), rare earth metals and the like are embraced in unavoidable impurities. The addition amounts of these elements may be those that are specified separately in the present specification. The contents of these unavoidable impurities are preferably less than 0.05% by weight.

Highly Corrosion-resistant Brass

The brass according to the present invention is a highly corrosion-resistant brass that is obtained without the need to undergo heat treatment and has suppressed dezincification corrosion. In the present invention, the reason why a highly corrosion-resistant brass that has suppressed dezincification corrosion can be realized without the need to undergo heat treatment has not been elucidated yet but is believed to be as follows. In the present invention, the contents of Sn and Al and the apparent zinc content are regulated in a range which will be described later. In the composition ratio, it is considered that Sn and Al are dissolved in solid solution in a larger amount in the β phase than the α phase and can effectively suppress the elution of zinc in the β phase. Consequently, dezincification corrosion can be suppressed. Sn is excellent particularly in the effect of improving corrosion resistance, and an increase in the addition amount of Sn leads to a tendency that a Sn-rich γ phase is newly formed (Sn in the β phase migrates to the γ phase). However, the present inventors have found that Al has the function of suppressing the precipitation of the γ phase. Accordingly, it is considered that the addition of Al enhances the corrosion resistance of the β phase and, at the same time, further enhances the effect of improving the corrosion resistance of Sn.

In the brass according to the present invention, there are first to fifteen embodiments that are divided into four groups, i.e., groups (I) to (IV), and each of the groups is divided into several subgroups, which will be specifically described.

First Embodiment: Group (I), Subgroup (1)

A brass comprising

Cu: not less than 55% by mass to not more than 75% by mass,

Si: not less than 0.01% by mass to not more than 0.1% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein (1) the apparent Zn content is not less than 37 and less than 39 and the following relationship is satisfied:

$$0.1 \le x \le 0.2 \text{ and } 0.1 < y \le 2.0 \text{ or} \quad (1\text{-}1)$$

$$0.2 < x \le 3.0 \text{ and } 0.1 \le y \le 2.0 \quad (1\text{-}2)$$

wherein x represents the content of Sn, % by mass; and y represents the content of Al, % by mass.

Second Embodiment: Group (I), Subgroup (2)

A brass comprising

Cu: not less than 55% by mass to not more than 75% by mass,

Si: not less than 0.01% by mass to not more than 0.1% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein (2) the apparent Zn content is not less than 39 and less than 43 and the following relationship is satisfied:

$$0.1 < x \le 0.2 \text{ and } -4x+0.9 < y \le 2.0 \text{ or} \quad (2\text{-}1)$$

$$0.2 < x \le 3.0 \text{ and } 0.1 \le y \le 2.0 \quad (2\text{-}2)$$

wherein x represents the content of Sn, % by mass; and y represents the content of Al, % by mass.

Third Embodiment: Group (I), Subgroup (3)

A brass comprising

Cu: not less than 55% by mass to not more than 75% by mass.

Si: not less than 0.01% by mass to not more than 0.1% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein (3) the apparent Zn content is not less than 43 and not more than 45 and the following relationship is satisfied:

$$0.1 \le x \le 0.2 \text{ and } 0.5 < y \le 2.0, \quad (3\text{-}1)$$

$$0.2 < x \le 0.3 \text{ and } -4x+1.3 < y \le 2.0, \text{ or} \quad (3\text{-}2)$$

$$0.3 < x \le 3.0 \text{ and } 0.1 \le y \le 2.0 \quad (3\text{-}3)$$

wherein x represents the content of Sn, by mass; and y represents the content of Al, % by mass.

Fourth Embodiment: Group (II), Subgroup (1)

A brass comprising

Cu: not less than 55% by mass to not more than 75% by mass,

Si: more than 0.1% by mass to not more than 0.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein (4) the apparent Zn content is not less than 37 and less than 39 and the following relationship is satisfied:

$$0.1 \le x \le 0.2 \text{ and } -5x+1.5 < y \le 2.0 \text{ or} \quad (4\text{-}1)$$

$$0.2 < x \le 3.0 \text{ and } 0.1 \le y \le 2.0 \quad (4\text{-}2)$$

wherein x represents the content of Sn, % by mass; and y represents the content of Al, % by mass.

Fifth Embodiment: Group (II), Subgroup (2)

A brass comprising

Cu: not less than 55% by mass to not more than 75% by mass,

Si: more than 0.1% by mass to not more than 0.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,
P as an optional ingredient: less than 0.15% by mass,
a rare earth metal as an optional ingredient: less than 0.004% by mass, and
the balance consisting of Zn and unavoidable impurities, wherein
(5) the apparent Zn content is not less than 39 to less than 41 and the following relationship is satisfied:

$$0.1<x\leq 0.2 \text{ and } -5x+1.5<y\leq 2.0 \text{ or} \quad (5\text{-}1)$$

$$0.2<x\leq 3.0 \text{ and } 0.1\leq y\leq 2.0 \quad (5\text{-}2)$$

wherein x represents the content of Sn, % by mass; and y represents the content of Al, % by mass.

Sixth Embodiment: Group (II), Subgroup (3)
A brass comprising
Cu: not less than 55% by mass to not more than 75% by mass,
Si: more than 0.1% by mass to not more than 0.5% by mass,
Sn and Al: amounts which meet the following relations,
Mn as an optional ingredient: less than 0.25% by mass,
Ti as an optional ingredient: less than 0.05% by mass,
Mg as an optional ingredient: less than 0.3% by mass,
P as an optional ingredient: less than 0.15% by mass,
a rare earth metal as an optional ingredient: less than 0.004% by mass, and
the balance consisting of Zn and unavoidable impurities, wherein
(6) the apparent Zn content is not less than 41 to less than 43 and the following relationship is satisfied:

$$0.1<x\leq 0.2 \text{ and } -5x+2.5<y\leq 2.0, \quad (6\text{-}1)$$

$$0.2<x\leq 0.3 \text{ and } -4x+1.3<y\leq 2.0, \quad (6\text{-}2)$$

$$0.3<x\leq 0.4 \text{ and } 0.1<y\leq 2.0 \text{ or} \quad (6\text{-}3)$$

$$0.3<x\leq 0.4 \text{ and } 0.1\leq y\leq 2.0 \quad (6\text{-}4)$$

wherein x represents the content of Sn, by mass: and y represents the content of Al, % by mass.

Seventh Embodiment: Group (II), Subgroup (4)
A brass comprising
Cu: not less than 55% by mass to not more than 75% by mass,
Si: more than 0.1% by mass to not more than 0.5% by mass,
Sn and Al: amounts which meet the following relations,
Mn as an optional ingredient: less than 0.25% by mass,
Ti as an optional ingredient: less than 0.05% by mass,
Mg as an optional ingredient: less than 0.3% by mass,
P as an optional ingredient: less than 0.15% by mass,
a rare earth metal as an optional ingredient: less than 0.004% by mass, and
the balance consisting of Zn and unavoidable impurities, wherein
(7) the apparent Zn content is not less than 43 and not more than 45 and the following relationship is satisfied:

$$0.3<x\leq 0.4 \text{ and } -5x+2.5<y\leq 2.0, \quad (7\text{-}1)$$

$$0.4<x\leq 0.5 \text{ and } -4x+2.1<y\leq 2.0 \text{ or} \quad (7\text{-}2)$$

$$0.5<x\leq 3.0 \text{ and } 0.1\leq y\leq 2.0 \quad (7\text{-}3)$$

wherein x represents the content of Sn, % by mass: and y represents the content of Al, % by mass.

Eighth Embodiment: Group (III), Subgroup (1)
A brass comprising
Cu: not less than 55% by mass to not more than 75% by mass,
Si: more than 0.5% by mass to not more than 1.0% by mass,
Sn and Al: amounts which meet the following relations,
Mn as an optional ingredient: less than 0.25% by mass,
Ti as an optional ingredient: less than 0.05% by mass,
Mg as an optional ingredient: less than 0.3% by mass,
P as an optional ingredient: less than 0.15% by mass,
a rare earth metal as an optional ingredient: less than 0.004% by mass, and
the balance consisting of Zn and unavoidable impurities, wherein
(8) the apparent Zn content is not less than 37 and less than 39 and the following relationship is satisfied:

$$0.1<x\leq 0.2 \text{ and } -4x+0.9<y\leq 2.0 \text{ or} \quad (8\text{-}1)$$

$$0.2<x\leq 3.0 \text{ and } 0.1\leq y\leq 2.0 \quad (8\text{-}2)$$

wherein x represents the content of Sn, % by mass: and y represents the content of Al, % by mass.

Ninth Embodiment: Group (III), Subgroup (2)
A brass comprising
Cu: not less than 55% by mass to not more than 75% by mass,
Si: more than 0.5% by mass to not more than 1.0% by mass,
Sn and Al: amounts which meet the following relations,
Mn as an optional ingredient: less than 0.25% by mass,
Ti as an optional ingredient: less than 0.05% by mass,
Mg as an optional ingredient: less than 0.3% by mass,
P as an optional ingredient: less than 0.15% by mass,
a rare earth metal as an optional ingredient: less than 0.004% by mass, and
the balance consisting of Zn and unavoidable impurities, wherein
(9) the apparent Zn content is not less than 39 and less than 41 and the following relationship is satisfied:

$$0.1<x\leq 0.2 \text{ and } -5x+2.0<y\leq 2.0, \quad (9\text{-}1)$$

$$0.2<x\leq 0.3 \text{ and } -4x+1.3<y\leq 2.0, \quad (9\text{-}2)$$

$$0.3<x\leq 0.4 \text{ and } 0.1<y\leq 2.0 \text{ or} \quad (9\text{-}3)$$

$$0.4<x\leq 3.0 \text{ and } 0.1\leq y\leq 2.0 \quad (9\text{-}4)$$

wherein x represents the content of Sn, % by mass; and y represents the content of Al, % by mass.

Tenth Embodiment: Group (III), Subgroup (3)
A brass comprising
Cu: not less than 55% by mass to not more than 75% by mass,
Si: more than 0.5% by mass to not more than 1.0% by mass,
Sn and Al: amounts which meet the following relations,
Mn as an optional ingredient: less than 0.25% by mass,
Ti as an optional ingredient: less than 0.05% by mass,
Mg as an optional ingredient: less than 0.3% by mass,
P as an optional ingredient: less than 0.15% by mass,
a rare earth metal as an optional ingredient: less than 0.004% by mass, and
the balance consisting of Zn and unavoidable impurities, wherein

(10) the apparent Zn content is not less than 41 and less than 43 and the following relationship is satisfied:

$$0.2<x\leq 0.3 \text{ and } -5x+2.5<y\leq 2.0, \quad (10\text{-}1)$$

$$0.3<x\leq 0.4 \text{ and } -4x+1.7<y\leq 2.0 \text{ or} \quad (10\text{-}2)$$

$$0.4<x\leq 3.0 \text{ and } 0.1\leq y\leq 2.0 \quad (10\text{-}3)$$

wherein x represents the content of Sn, % by mass; and y represents the content of Al, % by mass.

Eleventh Embodiment: Group (III), Subgroup (4)

A brass comprising

Cu: not less than 55% by mass to not more than 75% by mass,

Si: more than 0.5% by mass to not more than 1.0% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein

(11) the apparent Zn content is not less than 43 and not more than 45 and the following relationship is satisfied:

$$0.3<x\leq 0.4 \text{ and } -5x+3.0<y\leq 2.0 \text{ or} \quad (11\text{-}1)$$

$$0.4<x\leq 3.0 \text{ and } 0.1\leq y\leq 2.0 \quad (11\text{-}2)$$

wherein x represents the content of Sn, % by mass: and y represents the content of Al, % by mass.

Twelfth Embodiment: Group (IV), Subgroup (1)

A brass comprising

Cu: not less than 55% by mass to not more than 75% by mass,

Si: more than 1.0% by mass to not more than 1.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein

(12) the apparent Zn content is not less than 37 and less than 39 and the following relationship is satisfied:

$$0.1\leq x\leq 0.2 \text{ and } -4x+0.9<y\leq 2.0, \quad (12\text{-}1)$$

$$0.2<x\leq 0.3 \text{ and } 0.1<y\leq 2.0 \text{ or} \quad (12\text{-}2)$$

$$0.3<x\leq 3.0 \text{ and } 0.1\leq y\leq 2.0 \quad (12\text{-}3)$$

wherein x represents the content of Sn, % by mass: and y represents the content of Al, % by mass.

Thirteenth Embodiment: Group (IV), Subgroup (2)

A brass comprising

Cu: not less than 55% by mass to not more than 75% by mass,

Si: more than 1.0% by mass to not more than 1.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein

(13) the apparent Zn content is not less than 39 and less than 41 and the following relationship is satisfied:

$$0.1<x\leq 0.2 \text{ and } -5x+2.0<y\leq 2.0, \quad (13\text{-}1)$$

$$0.2<x\leq 0.3 \text{ and } 1.0<y\leq 2.0 \text{ or} \quad (13\text{-}2)$$

$$0.3<x\leq 3.0 \text{ and } 0.1\leq y\leq 2.0 \quad (13\text{-}3)$$

wherein x represents the content of Sn, % by mass; and y represents the content of Al, % by mass.

Fourteenth Embodiment: Group (IV), Subgroup (3)

A brass comprising

Cu: not less than 55% by mass to not more than 75% by mass,

Si: more than 1.0% by mass to not more than 1.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein

(14) the apparent Zn content is not less than 41 and less than 43 and the following relationship is satisfied:

$$0.4<x\leq 0.5 \text{ and } -5x+3.0<y\leq 2.0 \text{ or} \quad (14\text{-}1)$$

$$0.5<x\leq 3.0 \text{ and } 0.1\leq y\leq 2.0 \quad (14\text{-}2)$$

wherein x represents the content of Sn, % by mass; and y represents the content of Al, % by mass.

Fifteenth Embodiment: Group (IV), Subgroup (4)

A brass comprising

Cu: not less than 55% by mass to not more than 75% by mass,

Si: more than 1.0% by mass to not more than 1.5% by mass,

Sn and Al: amounts which meet the following relations,

Mn as an optional ingredient: less than 0.25% by mass,

Ti as an optional ingredient: less than 0.05% by mass,

Mg as an optional ingredient: less than 0.3% by mass,

P as an optional ingredient: less than 0.15% by mass, a rare earth metal as an optional ingredient: less than 0.004% by mass, and the balance consisting of Zn and unavoidable impurities, wherein

(15) the apparent Zn content is not less than 43 and not more than 45, the following relationship is satisfied:

$$0.2<x\leq 0.3 \text{ and } -5x+2.5<y\leq 2.0, \quad (15\text{-}1)$$

$$0.3<x\leq 0.4 \text{ and } -4x+1.7<y\leq 2.0 \text{ or} \quad (15\text{-}2)$$

$$0.4<x\leq 3.0 \text{ and } 0.1\leq y\leq 2.0 \quad (15\text{-}3)$$

wherein x represents the content of Sn, % by mass; and y represents the content of Al, % by mass.

Cu

In the present invention, Cu is contained in an amount of 55% by mass to 75% by mass. In all the above embodiments, the lower limit is preferably 60% by mass, and the upper limit is preferably 70% by mass. When the addition amount of Cu is excessively large, there is a possibility that casting cracks are formed due to crystallization of dendrites in a proeutectic α phase. On the other hand, when the addition amount of Cu is excessively small, there is a possibility that a lowering in various properties as brass, particularly deterioration in corrosion resistance, occurs. A combination of the addition amount of Cu, the addition amounts of Al and Sn, and the apparent zinc content can provide a highly corrosion-resistant brass having suppressed dezincification corrosion without undergoing heat treatment.

Si

The brass according to the present invention includes 0.01% by weight to 1.5% by weight of Si. The addition of Si has the effect of ensuring good castability. In general, however, the addition of Sn leads to a broadened coagulation temperature range and an increased tendency towards the occurrence of casting cracks or shrinkage. Accordingly, it has been regarded that, in frequent cases, the addition of a large amount of Sn to brass materials for casting should be avoided. According to finding obtained by the present inventors, however, the addition of Si suppressed the occurrence of the disadvantageous phenomena, contributing to the realization of highly corrosion-resistant brass materials that are castable and have not undergone a heat treatment step.

Sn, Al, and Apparent Zinc Content

In the present invention, a combination of Al and Sn in such addition amounts to satisfy the above relationship and the apparent zinc content can provide a highly corrosion-resistant brass having suppressed dezincification corrosion without undergoing heat treatment.

Optional Ingredients

In the brass according to the present invention, when Mn (manganese) is contained as an optional ingredient, the content of Mn is less than 0.25% by mass, preferably 0.2% by mass, more preferably less than 0.1% by mass. The addition of Mn has the effect of improving the strength. Since, however, Mn forms an intermetallic compound with Si (silicon), there is a possibility that Si is consumed, leading to lowered castability. Thus, the addition amount of Mn is preferably in the above-defined range.

When the brass according to the present invention contains Ti (titanium) as an optional ingredient, the content of Ti is less than 0.05% by mass, preferably less than 0.01% by mass, more preferably is 0 (zero). The addition of Ti has the effect of refining grains. Ti, however, is likely to be oxidized, and the addition of even a small amount leads to significantly lowered flowability in casting. Accordingly, preferably, Ti is not added.

When the brass according to the present invention contains Mg as an optional ingredient, the content of Mg is less than 0.3% by mass, preferably 0.05% by mass, more preferably 0 (zero). The addition of Mg has the effect of refining grains. Since, however, Mg forms an intermetallic compound with Si, there is a possibility that Si is consumed, leading to lowered castability. Thus, the addition amount of Mg is preferably in the above-defined range.

When the brass according to the present invention contains P (phosphorus) as an optional ingredient, the content of P is less than 0.15% by mass, preferably less than 0.1% by mass. The addition of P has the effect of suppressing dezincification corrosion. The addition of P leads to a broadened coagulation temperature range and an increased tendency towards the occurrence of casting cracks. Thus, the addition amount of P is preferably in the above-defined range.

When the brass according to the present invention contains a rare earth metal as an optional ingredient, the content of the rare earth metal is less than 0.004% by mass, preferably 0.001% by mass, more preferably 0 (zero). Here the rare earth metal refers to a group of elements including La (lanthanum) and Ce (cerium). The addition of the rare earth metal has the effect of refining grains. The rare earth metal, however, is likely to be oxidized, and the addition of even a small amount leads to significantly lowered flowability in casting. When the flowability is lowered, there is a possibility that the molten metal cannot be smoothly supplied and, thus, casting cracks are likely to occur in a finally coagulated portion. Accordingly, preferably, the rare earth metal is not added.

Pb and Bi

In a preferred embodiment of the present invention, the brass further contains one of Pb (lead) and Bi (bismuth) in an amount of 0.01% by weight to 4.0% by weight. The addition of these elements can improve chip partibility and provides good machinability. Further, the addition of these elements reduces cutting resistance and provides better machinability. On the other hand, Pb is a substance that is possibly harmful to human body and environment. Whether or not Bi is harmful has not been elucidated yet. However, it cannot be said that Bi is always harmless. Accordingly, the addition of these elements in a larger amount than needed is unfavorable. When reducing the cutting resistance and, at the same time, realizing good chip partibility are contemplated, the lower limit of the addition amount of each of Pb and Bi is preferably 0.3% by mass, more preferably 1.0% by mass, and the upper limit is preferably 3.5% by mass, more preferably 3.0% by mass. When only the chip partibility is expected, the lower limit of the addition amount of each of Pb and Bi is preferably 0.05% by mass, more preferably 0.1% by mass, and the upper limit is preferably 0.3% by mass, more preferably 0.25% by mass.

In a preferred embodiment of the present invention, when Pb and Bi are simultaneously added, the content of one of Pb and Bi is less than 0.5% by mass, preferably less than 0.1% by mass, more preferably 0 (zero). When both Pb and Bi are present, casting cracks are disadvantageously likely to occur. Accordingly, the addition amount is preferably in the above-defined range.

B

In a preferred embodiment of the present invention, the brass further contains 0.0001% by weight to 0.3% by weight of B (boron). The addition of B has the effect of suppressing the occurrence of casting cracks. On the other hand, when B is added in an excessive amount, there is a possibility that the spreadability of the alloy is deteriorated. Further, there is a possibility that the hardness of the alloy is increased and the cutting resistance in machining is increased, leading to an increased machining cost. The lower limit of the addition amount of B is preferably 0.0003% by mass, more preferably 0.0007% by mass, and the upper limit is preferably 0.03% by mass, more preferably 0.01% by mass.

When the brass according to the present invention contains Ni (nickel) as an optional ingredient, the content of Ni is not more than 0.7% by mass, preferably not more than 0.2% by mass, more preferably 0 (zero). The addition of Ni can improve mechanical properties but has a possibility that casting cracks are likely to occur. The occurrence of casting cracks can be suppressed to some extent by the addition of B. Even under the copresence of B, when the content of Ni is increased, the suppression becomes possibly difficult. Accordingly, in a preferred embodiment of the present invention, when B is contained, the addition amount of Ni is preferably not more than 0.7% by mass, while, when B is not contained, the addition amount of Ni is not more than 0.2% by mass.

Other Additive Elements

Other ingredients, for example, Sb (antimony) that, even when added in a very small amount, contributes to an improvement in corrosion resistance, and Fe (iron) that is expected as a refining agent to improve casting crack resistance and to improve the strength may be added as additive elements depending upon contemplated purposes to the brass according to the present invention.

These ingredients, when added in a certain amount, are likely to influence corrosion resistance and castability. The regulation of the contents of Al and Sn, Si, and the apparent zinc content can suppress the influence. Specifically, the influence can be suppressed by increasing the Al content in the above-defined range, conversely increasing the Sn content, increasing both the Al and Sn contents, or increasing or decreasing the Si content and the apparent Zn content.

In a preferred embodiment of the present invention, the brass according to the present invention contains at least one element selected from the group consisting of Sb (antimony), As (arsenic), Se (selenium), Te (tellurium), Fe (iron), Co (cobalt), Zr (zirconium), and Cr (chromium), preferably in an amount of 0.01 to 2% by mass. In another preferred embodiment of the present invention, the brass according to the present invention can contain at least one element selected from Sb and As for corrosion resistance improvement purposes, preferably in an amount of not more than 0.2% by mass. In still another preferred embodiment of the present invention, the brass according to the present invention contains Se or Te for machinability improvement purposes, preferably in an amount of not more than 1% by mass. In a further preferred embodiment of the present invention, the brass according to the present invention can contain at least one element selected from the group consisting of Fe, Co, Zr, and Cr for strength improvement purposes, preferably in an amount of not more than % by mass for Fe and Co and not more than 0.5% by mass for Zr and Cr.

Use

The brass according to the present invention can be provided and used without the need to undergo a heat treatment step that significantly affects the cost and productivity of dezincification-resistant brass. On the other hand, the brass possesses machinability, castability, and mechanical properties that are equivalent to or superior to those of Pb-containing brass. Accordingly, the brass according to the present invention can be used in the same applications where other brasses are used. In a preferred embodiment of the present invention, the brass according to the present invention can be preferably used in faucet metal fitting materials. Specific examples of preferred faucet metal fitting materials include materials for metal fittings for water supply, metal fittings for sewage, and valves.

Manufacturing Method

Molded products may be manufactured using the brass according to the present invention as a material by any of metal mold casting and sand mold casting by virtue of good castability. However, the effect of the good castability can be better enjoyed in the metal mold casting. Further, the brass according to the present invention also possesses good machinability and thus can be machined after casting. Furthermore, the brass according to the present invention, after continuous casting, can be extruded into rods to be machined or rods to be forged, or can be drawn into wire rods.

EXAMPLES

Casting Cracking Resistance Test

Casting cracking resistance was evaluated by a both end restraint testing method. A mold 1 used herein had a shape as shown in FIG. 1. In FIG. 1, an insulating material 2 was provided at the center portion so that the center portion was cooled slower than a both end restraint portion 3. The restraint end distance (2L) was 100 mm, and the insulating material length (2l) was 70 mm.

The test was carried out by a method in which the restraint portion was rapidly cooled to restrict both ends, and, in such a state, the center portion was coagulated. In this test, whether or not cracking was formed by coagulation shrinkage stress at the center portion that was a finally coagulated portion in the specimen was observed.

The casting cracking resistance was evaluated as ○ when cracking did not occur at all or partially occurred, that is, surface cracking occurred, but breaking did not occur; and the casting cracking resistance was evaluated as × when cracking that caused breaking of the specimen occurred.

Corrosion Resistance Test

An ingot having a diameter of 35 mm and a length of 100 mm was obtained by metal mold casting. This ingot was used as a specimen and was tested according to Japan Copper and Brass Association Technical Standard JBMA T-303-2007. The corrosion resistance was evaluated as ○ when the maximum corrosion depth was not more than 150 μm; and the corrosion resistance was evaluated as × when the maximum corrosion depth was more than 150 μm.

Machinability Test

An ingot having a diameter of 35 mm and a length of 100 mm was prepared by metal mold casting, and the outer diameter portion was machined to evaluate machinability. Specifically, the machinability was evaluated in terms of a cutting resistance index against brass casting third-class (JIS CAC203). Machining was carried out under conditions of a peripheral velocity of 80 to 175 m/min, a feed rate of 0.07 to 0.14 mm/rev., and a depth of cut of 0.25 to 1 mm. The cutting resistance index was calculated by the following equation.

$$\text{Cutting resistance index (\%)} = \text{cutting resistance of CAC203} / \text{cutting resistance of test material} \times 100$$

The machinability was evaluated as ○ when the cutting resistance index was not less than 50; and the machinability was evaluated as × when the cutting resistance index was less than 50%.

Further, when the outer diameter portion was machined, the partibility of formed chips was also evaluated. The chip partibility was evaluated as ○ when the chip was curled and parted within five windings; and the chip partibility was evaluated as × when the chip was not parted.

Examples 1 to 634

Brasses having respective compositions described in tables below were produced by casting. Specifically, electrolytic Cu (copper), electrolytic Zn (zinc), electrolytic Bi (bismuth), electrolytic Pb (lead), electrolytic Sn (tin), electrolytic Al (aluminum), a Cu-30% Ni mother alloy, a Cu-15% Si mother alloy, a Cu-2% B mother alloy, a Cu-30% Mn mother alloy, a Cu-10% Cr mother alloy, a Cu-15% P mother alloy, a Cu-10% Fe mother alloy, a Cu-30% Mg mother alloy and the like were melted as starting materials in an electric melting furnace while regulating ingredients, and the melt was cast in a both end restraint test mold, followed by evaluation of casting cracking resistance. Further, casting in a cylindrical mold was carried out to prepare ingots having a diameter of 35 mm and a length of 100 mm. The ingots were used as samples for tests of corrosion resistance and machinability. The results of evaluation were as shown in tables below.

TABLE 1-1

| No. | Cu | Pb | Bi | Zn | Sn | Al | Si | B | Ni | Apparent Zn content | (Castability) Cracking | (Machinability) Cutting resistance | (Machinability) Chip partibility |
|---|---|---|---|---|---|---|---|---|---|---|---|---|---|
| 1 | 80.00 | 0 | 2.00 | 13.24 | 0.70 | 2.00 | 2.00 | 0.0075 | 0.05 | 37.4 | x | ○ | ○ |
| 2 | 75.00 | 0 | 2.00 | 19.39 | 0.05 | 2.00 | 1.50 | 0.0075 | 0.05 | 38.8 | ○ | ○ | ○ |
| 3 | 70.00 | 0 | 2.00 | 25.49 | 0.05 | 1.00 | 1.40 | 0.0075 | 0.05 | 40.0 | ○ | ○ | ○ |
| 4 | 65.00 | 0 | 2.00 | 31.39 | 0.05 | 0.50 | 1.00 | 0.0075 | 0.05 | 41.2 | ○ | ○ | ○ |
| 5 | 60.00 | 0 | 2.00 | 37.19 | 0.05 | 0.10 | 0.60 | 0.0150 | 0.05 | 42.9 | ○ | ○ | ○ |
| 6 | 55.00 | 0 | 2.00 | 42.87 | 0.05 | 0 | 0 | 0.0300 | 0.05 | 44.5 | ○ | ○ | ○ |

15

TABLE 1-2

| No. | Cu | Pb | Bi | Zn | Sn | Al | Si | B | Ni | Apparent Zn content | Corrosion resistance | (Machinability) Cutting resistance | (Machinability) Chip partibility |
|---|---|---|---|---|---|---|---|---|---|---|---|---|---|
| 7 | 65.40 | 0 | 0 | 32.60 | 0.50 | 1.00 | 0.50 | 0.0020 | 0 | 40.5 | ○ | x | x |
| 8 | 65.40 | 0.01 | 0 | 32.59 | 0.50 | 1.00 | 0.50 | 0.0020 | 0 | 40.5 | ○ | x | ○ |
| 9 | 65.40 | 0.30 | 0 | 32.30 | 0.50 | 1.00 | 0.50 | 0.0020 | 0 | 40.5 | ○ | ○ | ○ |
| 10 | 65.40 | 1.00 | 0 | 31.60 | 0.50 | 1.00 | 0.50 | 0.0020 | 0 | 40.5 | ○ | ○ | ○ |
| 11 | 65.40 | 2.00 | 0 | 30.60 | 0.50 | 1.00 | 0.50 | 0.0020 | 0 | 40.5 | ○ | ○ | ○ |
| 12 | 65.40 | 3.00 | 0 | 29.60 | 0.50 | 1.00 | 0.50 | 0.0020 | 0 | 40.5 | ○ | ○ | ○ |
| 13 | 65.40 | 4.00 | 0 | 28.60 | 0.50 | 1.00 | 0.50 | 0.0020 | 0 | 40.5 | ○ | ○ | ○ |
| 14 | 65.40 | 0 | 0.01 | 32.59 | 0.50 | 1.00 | 0.50 | 0.0020 | 0 | 40.5 | ○ | x | ○ |
| 15 | 65.40 | 0 | 0.30 | 32.30 | 0.50 | 1.00 | 0.50 | 0.0020 | 0 | 40.5 | ○ | ○ | ○ |
| 16 | 65.20 | 0 | 1.00 | 31.80 | 0.50 | 1.00 | 0.50 | 0.0020 | 0 | 40.5 | ○ | ○ | ○ |
| 17 | 65.00 | 0 | 2.00 | 31.00 | 0.50 | 1.00 | 0.50 | 0.0020 | 0 | 40.5 | ○ | ○ | ○ |
| 18 | 64.70 | 0 | 3.00 | 30.30 | 0.50 | 1.00 | 0.50 | 0.0020 | 0 | 40.5 | ○ | ○ | ○ |
| 19 | 64.50 | 0 | 4.00 | 29.50 | 0.50 | 1.00 | 0.50 | 0.0020 | 0 | 40.5 | ○ | ○ | ○ |

TABLE 1-3

| No. | Cu | Pb | Si | Zn | Sn | Al | Si | B | Ni | Apparent Zn content | (Castability) Cracking | (Machinability) Cutting resistance | (Machinability) Chip partibility |
|---|---|---|---|---|---|---|---|---|---|---|---|---|---|
| 20 | 62.10 | 0.10 | 1.00 | 35.35 | 0.50 | 0.50 | 0.50 | 0 | 0.05 | 42.0 | x | ○ | ○ |
| 21 | 62.10 | 0.10 | 1.00 | 35.35 | 0.50 | 0.50 | 0.50 | 0.0001 | 0.05 | 42.0 | ○ | ○ | ○ |
| 22 | 62.10 | 0.10 | 1.00 | 35.35 | 0.50 | 0.50 | 0.50 | 0.0030 | 0.05 | 42.0 | ○ | ○ | ○ |
| 23 | 62.10 | 0.10 | 1.00 | 35.34 | 0.50 | 0.50 | 0.50 | 0.0100 | 0.05 | 42.0 | ○ | ○ | ○ |
| 24 | 62.10 | 0.10 | 1.00 | 35.32 | 0.50 | 0.50 | 0.50 | 0.0300 | 0.05 | 42.0 | ○ | ○ | ○ |
| 25 | 62.10 | 0.10 | 1.00 | 35.25 | 0.50 | 0.50 | 0.50 | 0.1000 | 0.05 | 42.0 | ○ | ○ | ○ |
| 26 | 62.10 | 0.10 | 1.00 | 35.05 | 0.50 | 0.50 | 0.50 | 0.3000 | 0.05 | 42.0 | ○ | ○ | ○ |
| 27 | 62.10 | 0.10 | 1.00 | 34.85 | 0.50 | 0.50 | 0.50 | 0.5000 | 0.05 | 42.0 | ○ | x | ○ |

TABLE 2-1

| No. | Cu | Pb | Zn | Sn | Al | Si | B | Apparent Zn content | Corrosion resistance |
|---|---|---|---|---|---|---|---|---|---|
| 28 | 65.70 | 2.00 | 31.20 | 0.00 | 1.00 | 0.10 | 0.002 | 38.0 | x |
| 29 | 68.80 | 2.00 | 27.10 | 0.00 | 2.00 | 0.10 | 0.002 | 38.0 | x |

TABLE 2-2

| No. | Cu | Pb | Zn | Sn | Al | Si | B | Apparent Zn content | Corrosion resistance |
|---|---|---|---|---|---|---|---|---|---|
| 30 | 64.20 | 2.00 | 33.10 | 0.10 | 0.50 | 0.10 | 0.002 | 38.0 | ○ |
| 31 | 67.30 | 2.00 | 29.00 | 0.10 | 1.50 | 0.10 | 0.002 | 38.0 | ○ |
| 32 | 68.80 | 2.00 | 27.00 | 0.10 | 2.00 | 0.10 | 0.002 | 38.0 | ○ |
| 33 | 65.70 | 2.00 | 31.10 | 0.10 | 1.00 | 0.10 | 0.002 | 38.0 | ○ |
| 34 | 62.90 | 2.00 | 34.80 | 0.10 | 0.10 | 0.10 | 0.002 | 38.0 | x |
| 35 | 63.00 | 2.00 | 34.60 | 0.20 | 0.10 | 0.10 | 0.002 | 38.0 | x |
| 36 | 67.30 | 2.00 | 28.90 | 0.20 | 1.50 | 0.10 | 0.002 | 38.0 | ○ |
| 37 | 64.20 | 2.00 | 33.00 | 0.20 | 0.50 | 0.10 | 0.002 | 38.0 | ○ |

15

TABLE 2-3

| No. | Cu | Pb | Zn | Sn | Al | Si | B | Apparent Zn content | Corrosion resistance |
|---|---|---|---|---|---|---|---|---|---|
| 38 | 63.10 | 2.00 | 34.40 | 0.30 | 0.10 | 0.10 | 0.002 | 38.0 | ○ |
| 39 | 63.10 | 2.00 | 34.30 | 0.40 | 0.10 | 0.10 | 0.002 | 38.0 | ○ |
| 40 | 67.00 | 2.00 | 29.40 | 0.50 | 1.00 | 0.10 | 0.002 | 37.0 | ○ |
| 41 | 66.00 | 2.00 | 30.40 | 0.50 | 1.00 | 0.10 | 0.002 | 38.0 | ○ |
| 42 | 63.20 | 2.00 | 34.10 | 0.50 | 0.10 | 0.10 | 0.002 | 38.0 | ○ |
| 43 | 69.10 | 2.00 | 26.30 | 0.50 | 2.00 | 0.10 | 0.002 | 38.0 | ○ |
| 44 | 66.30 | 2.00 | 29.60 | 1.00 | 1.00 | 0.10 | 0.002 | 38.0 | ○ |
| 45 | 69.40 | 2.00 | 25.50 | 1.00 | 2.00 | 0.10 | 0.002 | 38.0 | ○ |
| 46 | 63.50 | 2.00 | 33.30 | 1.00 | 0.10 | 0.10 | 0.002 | 38.0 | ○ |
| 47 | 66.90 | 2.00 | 28.00 | 2.00 | 1.00 | 0.10 | 0.002 | 38.0 | ○ |
| 48 | 70.00 | 2.00 | 23.90 | 2.00 | 2.00 | 0.10 | 0.002 | 38.0 | ○ |
| 49 | 64.10 | 2.00 | 31.70 | 2.00 | 0.10 | 0.10 | 0.002 | 38.0 | ○ |
| 50 | 70.60 | 2.00 | 22.30 | 3.00 | 2.00 | 0.10 | 0.002 | 38.0 | ○ |
| 51 | 64.70 | 2.00 | 30.10 | 3.00 | 0.10 | 0.10 | 0.002 | 38.0 | ○ |
| 52 | 67.50 | 2.00 | 26.40 | 3.00 | 1.00 | 0.10 | 0.002 | 38.0 | ○ |

TABLE 2-4

| No. | Cu | Pb | Zn | Sn | Al | Si | B | Apparent Zn content | Corrosion resistance |
|---|---|---|---|---|---|---|---|---|---|
| 53 | 60.50 | 2.00 | 37.40 | 0.00 | 0.00 | 0.10 | 0.002 | 40.0 | x |
| 54 | 63.50 | 2.00 | 33.40 | 0.00 | 1.00 | 0.10 | 0.002 | 40.0 | x |
| 55 | 61.40 | 2.00 | 35.50 | 0.00 | 1.00 | 0.10 | 0.002 | 42.0 | x |
| 56 | 62.90 | 2.00 | 33.50 | 0.00 | 1.50 | 0.10 | 0.002 | 42.0 | x |
| 57 | 66.50 | 2.00 | 29.40 | 0.00 | 2.00 | 0.10 | 0.002 | 40.0 | x |
| 58 | 64.30 | 2.00 | 31.60 | 0.00 | 2.00 | 0.10 | 0.002 | 42.0 | x |
| 59 | 60.90 | 2.00 | 36.80 | 0.10 | 0.10 | 0.10 | 0.002 | 40.0 | x |
| 60 | 62.10 | 2.00 | 35.20 | 0.10 | 0.50 | 0.10 | 0.002 | 40.0 | x |
| 61 | 60.00 | 2.00 | 37.30 | 0.10 | 0.50 | 0.10 | 0.002 | 42.0 | x |
| 62 | 63.60 | 2.00 | 33.20 | 0.10 | 1.00 | 0.10 | 0.002 | 40.0 | x |
| 63 | 61.50 | 2.00 | 35.30 | 0.10 | 1.00 | 0.10 | 0.002 | 42.0 | x |
| 64 | 65.10 | 2.00 | 31.20 | 0.10 | 1.50 | 0.10 | 0.002 | 40.0 | x |
| 65 | 62.90 | 2.00 | 33.40 | 0.10 | 1.50 | 0.10 | 0.002 | 42.0 | x |
| 66 | 66.60 | 2.00 | 29.20 | 0.10 | 2.00 | 0.10 | 0.002 | 40.0 | x |
| 67 | 64.40 | 2.00 | 31.40 | 0.10 | 2.00 | 0.10 | 0.002 | 42.0 | x |

TABLE 2-5

| No. | Cu | Pb | Zn | Sn | Al | Si | B | Apparent Zn content | Corrosion resistance |
|---|---|---|---|---|---|---|---|---|---|
| 68 | 61.00 | 2.00 | 36.60 | 0.20 | 0.10 | 0.10 | 0.002 | 40.0 | x |
| 60 | 58.90 | 2.00 | 38.70 | 0.20 | 0.10 | 0.10 | 0.002 | 42.0 | x |

TABLE 2-5-continued

| No. | Cu | Pb | Zn | Sn | Al | Si | B | Apparent Zn content | Corrosion resistance |
|---|---|---|---|---|---|---|---|---|---|
| 70 | 62.20 | 2.00 | 35.00 | 0.20 | 0.50 | 0.10 | 0.002 | 40.0 | ○ |
| 71 | 60.10 | 2.00 | 37.10 | 0.20 | 0.50 | 0.10 | 0.002 | 42.0 | ○ |
| 72 | 63.70 | 2.00 | 33.00 | 0.20 | 1.00 | 0.10 | 0.002 | 40.0 | ○ |
| 73 | 61.50 | 2.00 | 35.20 | 0.20 | 1.00 | 0.10 | 0.002 | 42.0 | ○ |
| 74 | 65.20 | 2.00 | 31.00 | 0.20 | 1.50 | 0.10 | 0.002 | 40.0 | ○ |
| 75 | 63.00 | 2.00 | 33.20 | 0.20 | 1.50 | 0.10 | 0.002 | 42.0 | ○ |
| 76 | 66.70 | 2.00 | 29.00 | 0.20 | 2.00 | 0.10 | 0.002 | 40.0 | ○ |
| 77 | 64.40 | 2.00 | 31.30 | 0.20 | 2.00 | 0.10 | 0.002 | 42.0 | ○ |

TABLE 2-6

| No. | Cu | Pb | Zn | Sn | Al | Si | B | Apparent Zn content | Corrosion resistance |
|---|---|---|---|---|---|---|---|---|---|
| 78 | 61.00 | 2.00 | 36.50 | 0.30 | 0.10 | 0.10 | 0.002 | 40.0 | ○ |
| 79 | 59.00 | 2.00 | 38.50 | 0.30 | 0.10 | 0.10 | 0.002 | 42.0 | ○ |
| 80 | 62.20 | 2.00 | 34.90 | 0.30 | 0.50 | 0.10 | 0.002 | 40.0 | ○ |
| 81 | 60.10 | 2.00 | 37.00 | 0.30 | 0.50 | 0.10 | 0.002 | 42.0 | ○ |
| 82 | 65.20 | 2.00 | 30.90 | 0.30 | 1.50 | 0.10 | 0.002 | 40.0 | ○ |
| 83 | 63.00 | 2.00 | 33.10 | 0.30 | 1.50 | 0.10 | 0.002 | 42.0 | ○ |
| 84 | 66.70 | 2.00 | 28.90 | 0.30 | 2.00 | 0.10 | 0.002 | 40.0 | ○ |
| 85 | 61.10 | 2.00 | 36.30 | 0.40 | 0.10 | 0.10 | 0.002 | 40.0 | ○ |
| 86 | 59.00 | 2.00 | 38.40 | 0.40 | 0.10 | 0.10 | 0.002 | 42.0 | ○ |
| 87 | 62.30 | 2.00 | 34.70 | 0.40 | 0.50 | 0.10 | 0.002 | 40.0 | ○ |
| 88 | 63.10 | 2.00 | 32.90 | 0.40 | 1.50 | 0.10 | 0.002 | 42.0 | ○ |
| 89 | 61.10 | 2.00 | 36.20 | 0.50 | 0.10 | 0.10 | 0.002 | 40.0 | ○ |
| 90 | 59.10 | 2.00 | 38.20 | 0.50 | 0.10 | 0.10 | 0.002 | 42.0 | ○ |
| 91 | 61.60 | 2.00 | 35.55 | 0.50 | 0.25 | 0.10 | 0.002 | 40.0 | ○ |
| 92 | 62.30 | 2.00 | 34.60 | 0.50 | 0.50 | 0.10 | 0.002 | 40.0 | ○ |
| 93 | 63.80 | 2.00 | 32.60 | 0.50 | 1.00 | 0.10 | 0.002 | 40.0 | ○ |
| 94 | 62.80 | 2.00 | 33.60 | 0.50 | 1.00 | 0.10 | 0.002 | 41.0 | ○ |
| 95 | 66.80 | 2.00 | 28.60 | 0.50 | 2.00 | 0.10 | 0.002 | 40.0 | ○ |
| 96 | 64.60 | 2.00 | 30.80 | 0.50 | 2.00 | 0.10 | 0.002 | 42.0 | ○ |
| 97 | 61.40 | 2.00 | 35.40 | 1.00 | 0.10 | 0.10 | 0.002 | 40.0 | ○ |
| 98 | 59.40 | 2.00 | 37.40 | 1.00 | 0.10 | 0.10 | 0.002 | 42.0 | ○ |
| 99 | 62.60 | 2.00 | 33.80 | 1.00 | 0.50 | 0.10 | 0.002 | 40.0 | ○ |
| 100 | 64.10 | 2.00 | 31.80 | 1.00 | 1.00 | 0.10 | 0.002 | 40.0 | ○ |
| 101 | 62.00 | 2.00 | 33.90 | 1.00 | 1.00 | 0.10 | 0.002 | 42.0 | ○ |
| 102 | 67.10 | 2.00 | 27.80 | 1.00 | 2.00 | 0.10 | 0.002 | 40.0 | ○ |
| 103 | 64.90 | 2.00 | 30.00 | 1.00 | 2.00 | 0.10 | 0.002 | 42.0 | ○ |
| 104 | 62.00 | 1.00 | 34.80 | 2.00 | 0.10 | 0.10 | 0.002 | 40.0 | ○ |
| 105 | 62.00 | 2.00 | 33.80 | 2.00 | 0.10 | 0.10 | 0.002 | 40.0 | ○ |
| 106 | 62.00 | 2.00 | 33.77 | 2.00 | 0.10 | 0.10 | 0.03 | 40.0 | ○ |
| 107 | 62.00 | 0.50 | 35.30 | 2.00 | 0.10 | 0.10 | 0.002 | 40.0 | ○ |
| 108 | 60.00 | 2.00 | 35.80 | 2.00 | 0.10 | 0.10 | 0.002 | 42.0 | ○ |
| 109 | 62.50 | 2.00 | 33.15 | 2.00 | 0.25 | 0.10 | 0.002 | 40.0 | ○ |
| 110 | 61.10 | 2.00 | 35.27 | 2.00 | 0.50 | 0.10 | 0.03 | 42.0 | ○ |
| 111 | 64.70 | 2.00 | 30.20 | 2.00 | 1.00 | 0.10 | 0.002 | 40.0 | ○ |
| 112 | 62.60 | 2.00 | 32.30 | 2.00 | 1.00 | 0.10 | 0.002 | 42.0 | ○ |
| 113 | 67.70 | 2.00 | 26.20 | 2.00 | 2.00 | 0.10 | 0.002 | 40.0 | ○ |
| 114 | 65.50 | 2.00 | 28.40 | 2.00 | 2.00 | 0.10 | 0.002 | 42.0 | ○ |
| 115 | 62.60 | 2.00 | 32.20 | 3.00 | 0.10 | 0.10 | 0.002 | 40.0 | ○ |
| 116 | 62.60 | 2.00 | 32.17 | 3.00 | 0.10 | 0.10 | 0.03 | 40.0 | ○ |
| 117 | 62.60 | 0.50 | 33.70 | 3.00 | 0.10 | 0.10 | 0.002 | 40.0 | ○ |
| 118 | 60.60 | 2.00 | 34.20 | 3.00 | 0.10 | 0.10 | 0.002 | 42.0 | ○ |
| 119 | 61.70 | 2.00 | 33.77 | 3.00 | 0.50 | 0.10 | 0.03 | 42.0 | ○ |
| 120 | 65.30 | 2.09 | 28.60 | 3.00 | 1.00 | 0.10 | 0.002 | 40.0 | ○ |
| 121 | 63.20 | 2.00 | 30.70 | 3.00 | 1.00 | 0.10 | 0.002 | 42.0 | ○ |
| 122 | 68.30 | 2.00 | 24.60 | 3.00 | 2.00 | 0.10 | 0.002 | 40.0 | ○ |
| 123 | 66.10 | 2.00 | 26.80 | 3.00 | 2.00 | 0.10 | 0.002 | 42.0 | ○ |

TABLE 2-7

| No. | Cu | Pb | Zn | Sn | Al | Si | B | Apparent Zn content | Corrosion resistance |
|---|---|---|---|---|---|---|---|---|---|
| 124 | 59.30 | 2.00 | 37.60 | 0.00 | 1.00 | 0.10 | 0.002 | 44.0 | x |
| 125 | 62.10 | 2.00 | 33.80 | 0.00 | 2.00 | 0.10 | 0.002 | 44.0 | x |

TABLE 2-8

| No. | Cu | Pb | Zn | Sn | Al | Si | B | Apparent Zn content | Corrosion resistance |
|---|---|---|---|---|---|---|---|---|---|
| 126 | 58.00 | 2.00 | 39.30 | 0.10 | 0.50 | 0.10 | 0.002 | 44.0 | x |
| 127 | 59.40 | 2.00 | 37.40 | 0.10 | 1.00 | 0.10 | 0.002 | 44.0 | ○ |
| 128 | 60.80 | 2.00 | 35.50 | 0.10 | 1.50 | 0.10 | 0.002 | 44.0 | ○ |
| 129 | 62.20 | 2.00 | 33.60 | 0.10 | 2.00 | 0.10 | 0.002 | 44.0 | ○ |
| 130 | 56.90 | 2.00 | 40.70 | 0.20 | 0.10 | 0.10 | 0.002 | 44.0 | x |
| 131 | 58.00 | 2.00 | 39.20 | 0.20 | 0.50 | 0.10 | 0.002 | 44.0 | x |
| 132 | 59.40 | 2.00 | 37.30 | 0.20 | 1.00 | 0.10 | 0.002 | 44.0 | ○ |
| 133 | 60.80 | 2.00 | 35.40 | 0.20 | 1.50 | 0.10 | 0.002 | 44.0 | ○ |

TABLE 2-9

| No. | Cu | Pb | Zn | Sn | Al | Si | B | Apparent Zn content | Corrosion resistance |
|---|---|---|---|---|---|---|---|---|---|
| 134 | 57.00 | 2.00 | 40.50 | 0.30 | 0.10 | 0.10 | 0.002 | 44.0 | x |
| 135 | 58.10 | 2.00 | 39.00 | 0.30 | 0.50 | 0.10 | 0.002 | 44.0 | ○ |
| 136 | 59.50 | 2.00 | 37.10 | 0.30 | 1.00 | 0.10 | 0.002 | 44.0 | ○ |
| 137 | 60.90 | 2.00 | 35.20 | 0.30 | 1.50 | 0.10 | 0.002 | 44.0 | ○ |

TABLE 2-10

| No. | Cu | Pb | Zn | Sn | Al | Si | B | Apparent Zn content | Corrosion resistance |
|---|---|---|---|---|---|---|---|---|---|
| 138 | 57.00 | 2.00 | 40.40 | 0.40 | 0.10 | 0.10 | 0.002 | 44.0 | ○ |
| 139 | 58.10 | 2.00 | 38.90 | 0.40 | 0.50 | 0.10 | 0.002 | 44.0 | ○ |
| 140 | 57.10 | 2.00 | 40.20 | 0.50 | 0.10 | 0.10 | 0.002 | 44.0 | ○ |
| 141 | 60.60 | 2.00 | 35.80 | 0.50 | 1.00 | 0.10 | 0.002 | 43.0 | ○ |
| 142 | 58.50 | 2.00 | 37.90 | 0.50 | 1.00 | 0.10 | 0.002 | 45.0 | ○ |
| 143 | 62.40 | 2.00 | 33.00 | 0.50 | 2.00 | 0.10 | 0.002 | 44.0 | ○ |
| 144 | 57.30 | 2.00 | 39.50 | 1.00 | 0.10 | 0.10 | 0.002 | 44.0 | ○ |
| 145 | 59.90 | 2.00 | 36.00 | 1.00 | 1.00 | 0.10 | 0.002 | 44.0 | ○ |
| 146 | 62.70 | 2.00 | 32.20 | 1.00 | 2.00 | 0.10 | 0.002 | 44.0 | ○ |
| 147 | 57.90 | 2.00 | 37.90 | 2.00 | 0.10 | 0.10 | 0.002 | 44.0 | ○ |
| 148 | 60.10 | 2.00 | 35.27 | 2.00 | 0.50 | 0.10 | 0.03 | 43.0 | ○ |
| 149 | 60.40 | 2.00 | 34.50 | 2.00 | 1.00 | 0.10 | 0.002 | 44.0 | ○ |
| 150 | 63.20 | 2.00 | 30.70 | 2.00 | 2.00 | 0.10 | 0.002 | 44.0 | ○ |
| 151 | 58.50 | 2.00 | 36.30 | 3.00 | 0.10 | 0.10 | 0.002 | 44.0 | ○ |
| 152 | 60.60 | 2.00 | 33.77 | 3.00 | 0.50 | 0.10 | 0.03 | 43.0 | ○ |
| 153 | 61.00 | 2.00 | 32.90 | 3.00 | 1.00 | 0.10 | 0.002 | 44.0 | ○ |
| 154 | 63.80 | 2.00 | 29.10 | 3.00 | 2.00 | 0.10 | 0.002 | 44.0 | ○ |

TABLE 3-1

| No. | Cu | Pb | Zn | Sn | Al | Si | B | Apparent Zn content | Corrosion resistance |
|---|---|---|---|---|---|---|---|---|---|
| 155 | 69.4 | 2 | 26.598 | 0 | 1.5 | 0.5 | 0.002 | 38.0 | x |

TABLE 3-2

| No. | Cu | Pb | Zn | Sn | Al | Si | B | Apparent Zn content | Corrosion resistance |
|---|---|---|---|---|---|---|---|---|---|
| 156 | 67.9 | 2 | 28.498 | 0.1 | 1 | 0.5 | 0.002 | 38.0 | x |
| 157 | 69.5 | 2 | 26.398 | 0.1 | 1.5 | 0.5 | 0.002 | 38.0 | ○ |
| 158 | 71 | 2 | 24.398 | 0.1 | 2 | 0.5 | 0.002 | 38.0 | ○ |
| 159 | 65.2 | 2 | 31.998 | 0.2 | 0.1 | 0.5 | 0.002 | 38.0 | x |
| 160 | 66.5 | 2 | 30.298 | 0.2 | 0.5 | 0.5 | 0.002 | 38.0 | x |
| 161 | 68 | 2 | 28.298 | 0.2 | 1 | 0.5 | 0.002 | 38.0 | ○ |
| 162 | 71.1 | 2 | 24.198 | 0.2 | 2 | 0.5 | 0.002 | 38.0 | ○ |

TABLE 3-3

| No. | Cu | Pb | Zn | Sn | Al | Si | B | Apparent Zn content | Corrosion resistance |
|---|---|---|---|---|---|---|---|---|---|
| 163 | 65.3 | 2 | 31.798 | 0.3 | 0.1 | 0.5 | 0.002 | 38.0 | ○ |
| 164 | 66.5 | 2 | 30.198 | 0.3 | 0.5 | 0.5 | 0.002 | 38.0 | ○ |
| 165 | 65.3 | 2 | 31.698 | 0.4 | 0.1 | 0.5 | 0.002 | 38.0 | ○ |
| 166 | 66.6 | 2 | 29.998 | 0.4 | 0.5 | 0.5 | 0.002 | 38.0 | ○ |
| 167 | 65.4 | 2 | 31.498 | 0.5 | 0.1 | 0.5 | 0.002 | 38.0 | ○ |
| 168 | 68.2 | 2 | 27.798 | 0.5 | 1 | 0.5 | 0.002 | 38.0 | ○ |
| 169 | 71.3 | 2 | 23.698 | 0.5 | 2 | 0.5 | 0.002 | 38.0 | ○ |
| 170 | 65.7 | 2 | 30.698 | 1 | 0.1 | 0.5 | 0.002 | 38.0 | ○ |
| 171 | 68.5 | 2 | 26.998 | 1 | 1 | 0.5 | 0.002 | 38.0 | ○ |
| 172 | 71.6 | 2 | 22.898 | 1 | 2 | 0.5 | 0.002 | 38.0 | ○ |
| 173 | 66.3 | 2 | 29.098 | 2 | 0.1 | 0.5 | 0.002 | 38.0 | ○ |
| 174 | 69.1 | 2 | 25.398 | 2 | 1 | 0.5 | 0.002 | 38.0 | ○ |
| 175 | 72.2 | 2 | 21.298 | 2 | 2 | 0.5 | 0.002 | 38.0 | ○ |
| 176 | 67 | 2 | 27.398 | 3 | 0.1 | 0.5 | 0.002 | 38.0 | ○ |
| 177 | 69.8 | 2 | 23.698 | 3 | 1 | 0.5 | 0.002 | 38.0 | ○ |
| 178 | 72.8 | 2 | 19.698 | 3 | 2 | 0.5 | 0.002 | 38.0 | ○ |

TABLE 3-4

| No. | Cu | Pb | Zn | Sn | Al | Si | B | Apparent Zn content | Corrosion resistance |
|---|---|---|---|---|---|---|---|---|---|
| 179 | 65.8 | 2 | 30.598 | 0.1 | 1 | 0.5 | 0.002 | 40.0 | x |
| 180 | 67.3 | 2 | 28.598 | 0.1 | 1.5 | 0.5 | 0.002 | 40.0 | x |
| 181 | 68.8 | 2 | 26.598 | 0.1 | 2 | 0.5 | 0.002 | 40.0 | x |

TABLE 3-5

| No. | Cu | Pb | Zn | Sn | Al | Si | B | Apparent Zn content | Corrosion resistance |
|---|---|---|---|---|---|---|---|---|---|
| 182 | 63.1 | 2 | 34.098 | 0.2 | 0.1 | 0.5 | 0.002 | 40.0 | x |
| 183 | 64.3 | 2 | 32.498 | 0.2 | 0.5 | 0.5 | 0.002 | 40.0 | x |
| 184 | 65.8 | 2 | 30.498 | 0.2 | 1 | 0.5 | 0.002 | 40.0 | ○ |
| 185 | 67.3 | 2 | 28.498 | 0.2 | 1.5 | 0.5 | 0.002 | 40.0 | ○ |
| 186 | 68.8 | 2 | 26.498 | 0.2 | 2 | 0.5 | 0.002 | 40.0 | ○ |

TABLE 3-6

| No. | Cu | Pb | Zn | Sn | Al | Si | B | Apparent Zn content | Corrosion resistance |
|---|---|---|---|---|---|---|---|---|---|
| 187 | 63.2 | 2 | 33.898 | 0.3 | 0.1 | 0.5 | 0.002 | 40.0 | ○ |
| 188 | 64.4 | 2 | 32.298 | 0.3 | 0.5 | 0.5 | 0.002 | 40.0 | ○ |
| 189 | 65.9 | 2 | 30.298 | 0.3 | 1 | 0.5 | 0.002 | 40.0 | ○ |
| 190 | 67.4 | 2 | 28.298 | 0.3 | 1.5 | 0.5 | 0.002 | 40.0 | ○ |
| 191 | 68.9 | 2 | 26.298 | 0.3 | 2 | 0.5 | 0.002 | 40.0 | ○ |
| 192 | 63.2 | 2 | 33.798 | 0.4 | 0.1 | 0.5 | 0.002 | 40.0 | ○ |
| 193 | 64.4 | 2 | 32.198 | 0.4 | 0.5 | 0.5 | 0.002 | 40.0 | ○ |
| 194 | 63.3 | 2 | 33.598 | 0.5 | 0.1 | 0.5 | 0.002 | 40.0 | ○ |
| 195 | 66 | 2 | 29.998 | 0.5 | 1 | 0.5 | 0.002 | 40.0 | ○ |
| 196 | 69 | 2 | 25.998 | 0.5 | 2 | 0.5 | 0.002 | 40.0 | ○ |
| 197 | 63.6 | 2 | 32.798 | 1 | 0.1 | 0.5 | 0.002 | 40.0 | ○ |
| 198 | 66.3 | 2 | 29.198 | 1 | 1 | 0.5 | 0.002 | 40.0 | ○ |
| 199 | 69.3 | 2 | 25.198 | 1 | 2 | 0.5 | 0.002 | 40.0 | ○ |
| 200 | 64.2 | 2 | 31.198 | 2 | 0.1 | 0.5 | 0.002 | 40.0 | ○ |
| 201 | 66.9 | 2 | 27.598 | 2 | 1 | 0.5 | 0.002 | 40.0 | ○ |
| 202 | 69.9 | 2 | 23.598 | 2 | 2 | 0.5 | 0.002 | 40.0 | ○ |
| 203 | 64.8 | 2 | 29.57 | 3 | 0.1 | 0.5 | 0.03 | 40.0 | ○ |
| 204 | 64.8 | 2 | 29.598 | 3 | 0.1 | 0.5 | 0.002 | 40.0 | ○ |
| 205 | 67.5 | 2 | 25.998 | 3 | 1 | 0.5 | 0.002 | 40.0 | ○ |
| 206 | 70.5 | 2 | 21.998 | 3 | 2 | 0.5 | 0.002 | 40.0 | ○ |

TABLE 3-7

| No. | Cu | Pb | Zn | Sn | Al | Si | B | Apparent Zn content | Corrosion resistance |
|---|---|---|---|---|---|---|---|---|---|
| 207 | 66.5 | 2 | 28.898 | 0.1 | 2 | 0.5 | 0.002 | 42.0 | x |
| 208 | 62.2 | 2 | 34.598 | 0.2 | 0.5 | 0.5 | 0.002 | 42.0 | x |
| 209 | 63.6 | 2 | 32.698 | 0.2 | 1 | 0.5 | 0.002 | 42.0 | x |
| 210 | 65.1 | 2 | 30.698 | 0.2 | 1.5 | 0.5 | 0.002 | 42.0 | x |
| 211 | 66.5 | 2 | 28.798 | 0.2 | 2 | 0.5 | 0.002 | 42.0 | ○ |

TABLE 3-8

| No. | Cu | Pb | Zn | Sn | Al | Si | B | Apparent Zn content | Corrosion resistance |
|---|---|---|---|---|---|---|---|---|---|
| 212 | 61.1 | 2 | 35.998 | 0.3 | 0.1 | 0.5 | 0.002 | 42.0 | x |
| 213 | 62.2 | 2 | 34.498 | 0.3 | 0.5 | 0.5 | 0.002 | 42.0 | ○ |
| 214 | 63.7 | 2 | 32.498 | 0.3 | 1 | 0.5 | 0.002 | 42.0 | ○ |
| 215 | 65.1 | 2 | 30.598 | 0.3 | 1.5 | 0.5 | 0.002 | 42.0 | ○ |
| 216 | 66.6 | 2 | 28.598 | 0.3 | 2 | 0.5 | 0.002 | 42.0 | ○ |

TABLE 3-9

| No. | Cu | Pb | Zn | Sn | Al | Si | B | Apparent Zn content | Corrosion resistance |
|---|---|---|---|---|---|---|---|---|---|
| 217 | 61.1 | 2 | 35.898 | 0.4 | 0.1 | 0.5 | 0.002 | 42.0 | x |
| 218 | 62.3 | 2 | 34.298 | 0.4 | 0.5 | 0.5 | 0.002 | 42.0 | ○ |
| 219 | 63.7 | 2 | 32.398 | 0.4 | 1 | 0.5 | 0.002 | 42.0 | ○ |

TABLE 3-10

| No. | Cu | Pb | Zn | Sn | Al | Si | B | Apparent Zn content | Corrosion resistance |
|---|---|---|---|---|---|---|---|---|---|
| 220 | 61.2 | 2 | 35.698 | 0.5 | 0.1 | 0.5 | 0.002 | 42.0 | ○ |
| 221 | 63.8 | 2 | 32.198 | 0.5 | 1 | 0.5 | 0.002 | 42.0 | ○ |
| 222 | 66.7 | 2 | 28.298 | 0.5 | 2 | 0.5 | 0.002 | 42.0 | ○ |
| 223 | 61.5 | 2 | 34.898 | 1 | 0.1 | 0.5 | 0.002 | 42.0 | ○ |
| 224 | 62.6 | 2 | 33.398 | 1 | 0.5 | 0.5 | 0.002 | 42.0 | ○ |
| 225 | 64.1 | 2 | 31.398 | 1 | 1 | 0.5 | 0.002 | 42.0 | ○ |

TABLE 3-10-continued

| No. | Cu | Pb | Zn | Sn | Al | Si | B | Apparent Zn content | Corrosion resistance |
|---|---|---|---|---|---|---|---|---|---|
| 226 | 65.5 | 2 | 29.498 | 1 | 1.5 | 0.5 | 0.002 | 42.0 | ○ |
| 227 | 67 | 2 | 27.498 | 1 | 2 | 0.5 | 0.002 | 42.0 | ○ |
| 228 | 62.1 | 2 | 33.298 | 2 | 0.1 | 0.5 | 0.002 | 42.0 | ○ |
| 229 | 63.2 | 2 | 31.798 | 2 | 0.5 | 0.5 | 0.002 | 42.0 | ○ |
| 230 | 64.7 | 2 | 29.798 | 2 | 1 | 0.5 | 0.002 | 42.0 | ○ |
| 231 | 66.1 | 2 | 27.898 | 2 | 1.5 | 0.5 | 0.002 | 42.0 | ○ |
| 232 | 67.6 | 2 | 25.898 | 2 | 2 | 0.5 | 0.002 | 42.0 | ○ |
| 233 | 62.6 | 2 | 31.798 | 3 | 0.1 | 0.5 | 0.002 | 42.0 | ○ |
| 234 | 63.8 | 2 | 30.198 | 3 | 0.5 | 0.5 | 0.002 | 42.0 | ○ |
| 235 | 65.2 | 2 | 28.298 | 3 | 1 | 0.5 | 0.002 | 42.0 | ○ |
| 236 | 66.7 | 2 | 26.298 | 3 | 1.5 | 0.5 | 0.002 | 42.0 | ○ |
| 237 | 68.1 | 2 | 24.398 | 3 | 2 | 0.5 | 0.002 | 42.0 | ○ |

TABLE 3-11

| No. | Cu | Pb | Zn | Sn | Al | Si | B | Apparent Zn content | Corrosion resistance |
|---|---|---|---|---|---|---|---|---|---|
| 238 | 61.4 | 2 | 34.898 | 0.2 | 1 | 0.5 | 0.002 | 44.0 | x |
| 239 | 61.5 | 2 | 34.698 | 0.3 | 1 | 0.5 | 0.002 | 44.0 | x |
| 240 | 62.9 | 2 | 32.798 | 0.3 | 1.5 | 0.5 | 0.002 | 44.0 | x |
| 241 | 64.3 | 2 | 30.898 | 0.3 | 2 | 0.5 | 0.002 | 44.0 | x |

TABLE 3-12

| No. | Cu | Pb | Zn | Sn | Al | Si | B | Apparent Zn content | Corrosion resistance |
|---|---|---|---|---|---|---|---|---|---|
| 242 | 60.1 | 2 | 36.498 | 0.4 | 0.5 | 0.5 | 0.002 | 44.0 | x |
| 243 | 61.5 | 2 | 34.598 | 0.4 | 1 | 0.5 | 0.002 | 44.0 | ○ |
| 244 | 62.9 | 2 | 32.698 | 0.4 | 1.5 | 0.5 | 0.002 | 44.0 | ○ |
| 245 | 64.3 | 2 | 30.798 | 0.4 | 2 | 0.5 | 0.002 | 44.0 | ○ |

TABLE 3-13

| No. | Cu | Pb | Zn | Sn | Al | Si | B | Apparent Zn content | Corrosion resistance |
|---|---|---|---|---|---|---|---|---|---|
| 246 | 59.1 | 2 | 37.798 | 0.5 | 0.1 | 0.5 | 0.002 | 44.0 | x |
| 247 | 60.2 | 2 | 36.298 | 0.5 | 0.5 | 0.5 | 0.002 | 44.0 | ○ |
| 248 | 61.6 | 2 | 34.398 | 0.5 | 1 | 0.5 | 0.002 | 44.0 | ○ |
| 249 | 63 | 2 | 32.498 | 0.5 | 1.5 | 0.5 | 0.002 | 44.0 | ○ |
| 250 | 64.4 | 2 | 30.598 | 0.5 | 2 | 0.5 | 0.002 | 44.0 | ○ |

TABLE 3-14

| No. | Cu | Pb | Zn | Sn | Al | Si | B | Apparent Zn content | Corrosion resistance |
|---|---|---|---|---|---|---|---|---|---|
| 251 | 59.4 | 2 | 36.998 | 1 | 0.1 | 0.5 | 0.002 | 44.0 | ○ |
| 252 | 61.9 | 2 | 33.598 | 1 | 1 | 0.5 | 0.002 | 44.0 | ○ |
| 253 | 64.7 | 2 | 29.798 | 1 | 2 | 0.5 | 0.002 | 44.0 | ○ |
| 254 | 59.9 | 2 | 35.498 | 2 | 0.1 | 0.5 | 0.002 | 44.0 | ○ |
| 255 | 62.4 | 2 | 32.098 | 2 | 1 | 0.5 | 0.002 | 44.0 | ○ |
| 256 | 65.2 | 2 | 28.298 | 2 | 2 | 0.5 | 0.002 | 44.0 | ○ |
| 257 | 60.5 | 2 | 33.898 | 3 | 0.1 | 0.5 | 0.002 | 44.0 | ○ |
| 258 | 63 | 2 | 30.498 | 3 | 1 | 0.5 | 0.002 | 44.0 | ○ |
| 259 | 65.8 | 2 | 26.698 | 3 | 2 | 0.5 | 0.002 | 44.0 | ○ |

TABLE 4-1

| No. | Cu | Pb | Zn | Sn | Al | Si | B | Apparent Zn content | Corrosion resistance |
|---|---|---|---|---|---|---|---|---|---|
| 260 | 69.2 | 2 | 27.198 | 0.1 | 0.5 | 1 | 0.002 | 38.0 | x |
| 261 | 70.7 | 2 | 25.198 | 0.1 | 1 | 1 | 0.002 | 38.0 | x |
| 262 | 72.3 | 2 | 23.098 | 0.1 | 1.5 | 1 | 0.002 | 38.0 | x |
| 263 | 73.9 | 2 | 20.998 | 0.1 | 2 | 1 | 0.002 | 38.0 | x |

TABLE 4-2

| No. | Cu | Pb | Zn | Sn | Al | Si | B | Apparent Zn content | Corrosion resistance |
|---|---|---|---|---|---|---|---|---|---|
| 264 | 68 | 2 | 28.698 | 0.2 | 0.1 | 1 | 0.002 | 38.0 | x |
| 265 | 69.3 | 2 | 26.998 | 0.2 | 0.5 | 1 | 0.002 | 38.0 | ○ |
| 266 | 70.8 | 2 | 24.998 | 0.2 | 1 | 1 | 0.002 | 38.0 | ○ |
| 267 | 72.3 | 2 | 22.998 | 0.2 | 1.5 | 1 | 0.002 | 38.0 | ○ |
| 268 | 73.9 | 2 | 20.898 | 0.2 | 2 | 1 | 0.002 | 38.0 | ○ |

TABLE 4-3

| No. | Cu | Pb | Zn | Sn | Al | Si | B | Apparent Zn content | Corrosion resistance |
|---|---|---|---|---|---|---|---|---|---|
| 269 | 68.1 | 2 | 28.498 | 0.3 | 0.1 | 1 | 0.002 | 38.0 | ○ |
| 270 | 69.3 | 2 | 26.898 | 0.3 | 0.5 | 1 | 0.002 | 38.0 | ○ |
| 271 | 70.9 | 2 | 24.798 | 0.3 | 1 | 1 | 0.002 | 38.0 | ○ |
| 272 | 72.4 | 2 | 22.798 | 0.3 | 1.5 | 1 | 0.002 | 38.0 | ○ |
| 273 | 74 | 2 | 20.698 | 0.3 | 2 | 1 | 0.002 | 38.0 | ○ |
| 274 | 68.1 | 2 | 28.398 | 0.4 | 0.1 | 1 | 0.002 | 38.0 | ○ |
| 275 | 72.5 | 2 | 22.598 | 0.4 | 1.5 | 1 | 0.002 | 38.0 | ○ |
| 276 | 74 | 2 | 20.598 | 0.4 | 2 | 1 | 0.002 | 38.0 | ○ |
| 277 | 68.2 | 2 | 28.198 | 0.5 | 0.1 | 1 | 0.002 | 38.0 | ○ |
| 278 | 71 | 2 | 24.498 | 0.5 | 1 | 1 | 0.002 | 38.0 | ○ |
| 279 | 72.5 | 2 | 22.498 | 0.5 | 1.5 | 1 | 0.002 | 38.0 | ○ |
| 280 | 74.1 | 2 | 20.398 | 0.5 | 2 | 1 | 0.002 | 38.0 | ○ |
| 281 | 68.5 | 2 | 27.398 | 1 | 0.1 | 1 | 0.002 | 38.0 | ○ |
| 282 | 71.3 | 2 | 23.698 | 1 | 1 | 1 | 0.002 | 38.0 | ○ |
| 283 | 74.4 | 2 | 19.598 | 1 | 2 | 1 | 0.002 | 38.0 | ○ |
| 284 | 69.1 | 2 | 25.798 | 2 | 0.1 | 1 | 0.002 | 38.0 | ○ |
| 285 | 71.9 | 2 | 22.098 | 2 | 1 | 1 | 0.002 | 38.0 | ○ |
| 286 | 75 | 2 | 17.998 | 2 | 2 | 1 | 0.002 | 38.0 | ○ |
| 287 | 69.7 | 2 | 24.198 | 3 | 0.1 | 1 | 0.002 | 38.0 | ○ |
| 288 | 72.5 | 2 | 20.498 | 3 | 1 | 1 | 0.002 | 38.0 | ○ |
| 289 | 75 | 2 | 16.998 | 3 | 2 | 1 | 0.002 | 38.5 | ○ |

TABLE 4-4

| No. | Cu | Pb | Zn | Sn | Al | Si | B | Apparent Zn content | Corrosion resistance |
|---|---|---|---|---|---|---|---|---|---|
| 290 | 70 | 2 | 25.398 | 0.1 | 1.5 | 1 | 0.002 | 40.0 | x |
| 291 | 71.5 | 2 | 23.398 | 0.1 | 2 | 1 | 0.002 | 40.0 | x |

TABLE 4-5

| No. | Cu | Pb | Zn | Sn | Al | Si | B | Apparent Zn content | Corrosion resistance |
|---|---|---|---|---|---|---|---|---|---|
| 292 | 67 | 2 | 29.298 | 0.2 | 0.5 | 1 | 0.002 | 40.0 | x |
| 293 | 68.5 | 2 | 27.298 | 0.2 | 1 | 1 | 0.002 | 40.0 | x |
| 294 | 70 | 2 | 25.298 | 0.2 | 1.5 | 1 | 0.002 | 40.0 | ○ |
| 295 | 71.5 | 2 | 23.298 | 0.2 | 2 | 1 | 0.002 | 40.0 | ○ |

TABLE 4-6

| No. | Cu | Pb | Zn | Sn | Al | Si | B | Apparent Zn content | Corrosion resistance |
|---|---|---|---|---|---|---|---|---|---|
| 296 | 65.9 | 2 | 30.698 | 0.3 | 0.1 | 1 | 0.002 | 40.0 | x |
| 297 | 67.1 | 2 | 29.098 | 0.3 | 0.5 | 1 | 0.002 | 40.0 | ○ |
| 298 | 68.6 | 2 | 27.098 | 0.3 | 1 | 1 | 0.002 | 40.0 | ○ |
| 299 | 70.1 | 2 | 25.098 | 0.3 | 1.5 | 1 | 0.002 | 40.0 | ○ |
| 300 | 71.6 | 2 | 23.098 | 0.3 | 2 | 1 | 0.002 | 40.0 | ○ |

TABLE 4-7

| No. | Cu | Pb | Zn | Sn | Al | Si | B | Apparent Zn content | Corrosion resistance |
|---|---|---|---|---|---|---|---|---|---|
| 301 | 65.9 | 2 | 30.598 | 0.4 | 0.1 | 1 | 0.002 | 40.0 | x |
| 302 | 67.1 | 2 | 28.998 | 0.4 | 0.5 | 1 | 0.002 | 40.0 | ○ |
| 303 | 68.6 | 2 | 26.998 | 0.4 | 1 | 1 | 0.002 | 40.0 | ○ |
| 304 | 71.6 | 2 | 22.998 | 0.4 | 2 | 1 | 0.002 | 40.0 | ○ |

TABLE 4-8

| No. | Cu | Pb | Zn | Sn | Al | Si | B | Apparent Zn content | Corrosion resistance |
|---|---|---|---|---|---|---|---|---|---|
| 305 | 66 | 2 | 30.398 | 0.5 | 0.1 | 1 | 0.002 | 40.0 | ○ |
| 306 | 67.2 | 2 | 28.798 | 0.5 | 0.5 | 1 | 0.002 | 40.0 | ○ |
| 307 | 68.7 | 2 | 26.798 | 0.5 | 1 | 1 | 0.002 | 40.0 | ○ |
| 308 | 71.7 | 2 | 22.798 | 0.5 | 2 | 1 | 0.002 | 40.0 | ○ |
| 309 | 66.3 | 2 | 29.598 | 1 | 0.1 | 1 | 0.002 | 40.0 | ○ |
| 310 | 69 | 2 | 25.998 | 1 | 1 | 1 | 0.002 | 40.0 | ○ |
| 311 | 72 | 2 | 21.998 | 1 | 2 | 1 | 0.002 | 40.0 | ○ |
| 312 | 66.9 | 2 | 27.998 | 2 | 0.1 | 1 | 0.002 | 40.0 | ○ |
| 313 | 69.6 | 2 | 24.398 | 2 | 1 | 1 | 0.002 | 40.0 | ○ |
| 314 | 72.6 | 2 | 20.398 | 2 | 2 | 1 | 0.002 | 40.0 | ○ |
| 315 | 67.5 | 2 | 26.398 | 3 | 0.1 | 1 | 0.002 | 40.0 | ○ |
| 316 | 70.2 | 2 | 22.798 | 3 | 1 | 1 | 0.002 | 40.0 | ○ |
| 317 | 73.2 | 2 | 18.798 | 3 | 2 | 1 | 0.002 | 40.0 | ○ |

TABLE 4-9

| No. | Cu | Pb | Zn | Sn | Al | Si | B | Apparent Zn content | Corrosion resistance |
|---|---|---|---|---|---|---|---|---|---|
| 318 | 67.7 | 2 | 27.598 | 0.2 | 1.5 | 1 | 0.002 | 42.0 | x |
| 319 | 69.1 | 2 | 25.698 | 0.2 | 2 | 1 | 0.002 | 42.0 | x |

TABLE 4-10

| No. | Cu | Pb | Zn | Sn | Al | Si | B | Apparent Zn content | Corrosion resistance |
|---|---|---|---|---|---|---|---|---|---|
| 320 | 64.8 | 2 | 31.398 | 0.3 | 0.5 | 1 | 0.002 | 42.0 | x |
| 321 | 66.3 | 2 | 29.398 | 0.3 | 1 | 1 | 0.002 | 42.0 | x |
| 322 | 67.7 | 2 | 27.498 | 0.3 | 1.5 | 1 | 0.002 | 42.0 | ○ |
| 323 | 69.2 | 2 | 25.498 | 0.3 | 2 | 1 | 0.002 | 42.0 | ○ |

TABLE 4-11

| No. | Cu | Pb | Zn | Sn | Al | Si | B | Apparent Zn content | Corrosion resistance |
|---|---|---|---|---|---|---|---|---|---|
| 324 | 63.7 | 2 | 32.798 | 0.4 | 0.1 | 1 | 0.002 | 42.0 | x |

TABLE 4-11-continued

| No. | Cu | Pb | Zn | Sn | Al | Si | B | Apparent Zn content | Corrosion resistance |
|---|---|---|---|---|---|---|---|---|---|
| 326 | 64.9 | 2 | 31.198 | 0.4 | 0.5 | 1 | 0.002 | 42.0 | ○ |
| 327 | 66.3 | 2 | 29.298 | 0.4 | 1 | 1 | 0.002 | 42.0 | ○ |
| 328 | 69.2 | 2 | 25.398 | 0.4 | 2 | 1 | 0.002 | 42.0 | ○ |

TABLE 4-12

| No. | Cu | Pb | Zn | Sn | Al | Si | B | Apparent Zn content | Corrosion resistance |
|---|---|---|---|---|---|---|---|---|---|
| 329 | 63.8 | 2 | 32.598 | 0.5 | 0.1 | 1 | 0.002 | 42.0 | ○ |
| 330 | 66.4 | 2 | 29.098 | 0.5 | 1 | 1 | 0.002 | 42.0 | ○ |
| 331 | 69.3 | 2 | 25.198 | 0.5 | 2 | 1 | 0.002 | 42.0 | ○ |
| 332 | 64.1 | 2 | 31.798 | 1 | 0.1 | 1 | 0.002 | 42.0 | ○ |
| 333 | 66.7 | 2 | 28.298 | 1 | 1 | 1 | 0.002 | 42.0 | ○ |
| 334 | 69.6 | 2 | 24.398 | 1 | 2 | 1 | 0.002 | 42.0 | ○ |
| 335 | 64.7 | 2 | 30.198 | 2 | 0.1 | 1 | 0.002 | 42.0 | ○ |
| 336 | 67.3 | 2 | 26.698 | 2 | 1 | 1 | 0.002 | 42.0 | ○ |
| 337 | 70.2 | 2 | 22.798 | 2 | 2 | 1 | 0.002 | 42.0 | ○ |
| 338 | 65.2 | 2 | 28.698 | 3 | 0.1 | 1 | 0.002 | 42.0 | ○ |
| 339 | 67.9 | 2 | 25.098 | 3 | 1 | 1 | 0.002 | 42.0 | ○ |
| 340 | 70.8 | 2 | 21.198 | 3 | 2 | 1 | 0.002 | 42.0 | ○ |

TABLE 4-13

| No. | Cu | Pb | Zn | Sn | Al | Si | B | Apparent Zn content | Corrosion resistance |
|---|---|---|---|---|---|---|---|---|---|
| 341 | 65.4 | 2 | 29.798 | 0.3 | 1.5 | 1 | 0.002 | 44.0 | x |
| 342 | 66.8 | 2 | 27.898 | 0.3 | 2 | 1 | 0.002 | 44.0 | x |

TABLE 4-14

| No. | Cu | Pb | Zn | Sn | Al | Si | B | Apparent Zn content | Corrosion resistance |
|---|---|---|---|---|---|---|---|---|---|
| 343 | 61.5 | 2 | 34.998 | 0.4 | 0.1 | 1 | 0.002 | 44.0 | x |
| 344 | 62.7 | 2 | 33.398 | 0.4 | 0.5 | 1 | 0.002 | 44.0 | x |
| 345 | 64.1 | 2 | 31.498 | 0.4 | 1 | 1 | 0.002 | 44.0 | x |
| 346 | 65.5 | 2 | 29.598 | 0.4 | 1.5 | 1 | 0.002 | 44.0 | ○ |
| 347 | 66.9 | 2 | 27.698 | 0.4 | 2 | 1 | 0.002 | 44.0 | ○ |

TABLE 4-15

| No. | Cu | Pb | Zn | Sn | Al | Si | B | Apparent Zn content | Corrosion resistance |
|---|---|---|---|---|---|---|---|---|---|
| 348 | 61.6 | 2 | 34.798 | 0.5 | 0.1 | 1 | 0.002 | 44.0 | ○ |
| 349 | 62.7 | 2 | 33.298 | 0.5 | 0.5 | 1 | 0.002 | 44.0 | ○ |
| 350 | 64.1 | 2 | 31.398 | 0.5 | 1 | 1 | 0.002 | 44.0 | ○ |
| 351 | 66.9 | 2 | 27.598 | 0.5 | 2 | 1 | 0.002 | 44.0 | ○ |
| 352 | 61.9 | 2 | 33.998 | 1 | 0.1 | 1 | 0.002 | 44.0 | ○ |
| 353 | 63 | 2 | 32.498 | 1 | 0.5 | 1 | 0.002 | 44.0 | ○ |
| 354 | 64.4 | 2 | 30.598 | 1 | 1 | 1 | 0.002 | 44.0 | ○ |
| 355 | 65.8 | 2 | 28.698 | 1 | 1.5 | 1 | 0.002 | 44.0 | ○ |
| 356 | 67.2 | 2 | 26.798 | 1 | 2 | 1 | 0.002 | 44.0 | ○ |
| 357 | 62.4 | 2 | 32.498 | 2 | 0.1 | 1 | 0.002 | 44.0 | ○ |
| 358 | 63.6 | 2 | 30.898 | 2 | 0.5 | 1 | 0.002 | 44.0 | ○ |
| 359 | 65 | 2 | 28.998 | 2 | 1 | 1 | 0.002 | 44.0 | ○ |
| 360 | 66.4 | 2 | 27.098 | 2 | 1.5 | 1 | 0.002 | 44.0 | ○ |
| 361 | 67.7 | 2 | 25.298 | 2 | 2 | 1 | 0.002 | 44.0 | ○ |

TABLE 4-15-continued

| No. | Cu | Pb | Zn | Sn | Al | Si | B | Apparent Zn content | Corrosion resistance |
|---|---|---|---|---|---|---|---|---|---|
| 362 | 63 | 2 | 30.898 | 3 | 0.1 | 1 | 0.002 | 44.0 | ○ |
| 363 | 65.5 | 2 | 27.498 | 3 | 1 | 1 | 0.002 | 44.0 | ○ |
| 364 | 68.3 | 2 | 23.698 | 3 | 2 | 1 | 0.002 | 44.0 | ○ |

TABLE 5-1

| No. | Cu | Pb | Zn | Sn | Al | Si | B | Apparent Zn content | Corrosion resistance |
|---|---|---|---|---|---|---|---|---|---|
| 365 | 73.5 | 2 | 21.998 | 0 | 1 | 1.5 | 0.002 | 38.0 | x |

TABLE 5-2

| No. | Cu | Pb | Zn | Sn | Al | Si | B | Apparent Zn content | Corrosion resistance |
|---|---|---|---|---|---|---|---|---|---|
| 366 | 72 | 2 | 23.898 | 0.1 | 0.5 | 1.5 | 0.002 | 38.0 | x |
| 367 | 73.5 | 2 | 21.898 | 0.1 | 1 | 1.5 | 0.002 | 38.0 | ○ |
| 368 | 75 | 2 | 19.898 | 0.1 | 1.5 | 1.5 | 0.002 | 38.1 | ○ |
| 369 | 70.8 | 2 | 25.398 | 0.2 | 0.1 | 1.5 | 0.002 | 38.0 | x |
| 370 | 72.1 | 2 | 23.698 | 0.2 | 0.5 | 1.5 | 0.002 | 38.0 | ○ |
| 371 | 73.6 | 2 | 21.698 | 0.2 | 1 | 1.5 | 0.002 | 38.0 | ○ |

TABLE 5-3

| No. | Cu | Pb | Zn | Sn | Al | Si | B | Apparent Zn content | Corrosion resistance |
|---|---|---|---|---|---|---|---|---|---|
| 372 | 70.9 | 2 | 25.198 | 0.3 | 0.1 | 1.5 | 0.002 | 38.0 | x |
| 373 | 72.1 | 2 | 23.598 | 0.3 | 0.5 | 1.5 | 0.002 | 38.0 | ○ |
| 374 | 73.7 | 2 | 21.498 | 0.3 | 1 | 1.5 | 0.002 | 38.0 | ○ |
| 375 | 75 | 2 | 19.698 | 0.3 | 1.5 | 1.5 | 0.002 | 38.2 | ○ |

TABLE 5-4

| No. | Cu | Pb | Zn | Sn | Al | Si | B | Apparent Zn content | Corrosion resistance |
|---|---|---|---|---|---|---|---|---|---|
| 376 | 70.9 | 2 | 25.098 | 0.4 | 0.1 | 1.5 | 0.002 | 38.0 | ○ |
| 377 | 71 | 2 | 24.898 | 0.5 | 0.1 | 1.5 | 0.002 | 38.0 | ○ |
| 378 | 73.8 | 2 | 21.198 | 0.5 | 1 | 1.5 | 0.002 | 38.0 | ○ |
| 379 | 71.3 | 2 | 24.098 | 1 | 0.1 | 1.5 | 0.002 | 38.0 | ○ |
| 380 | 74.1 | 2 | 20.398 | 1 | 1 | 1.5 | 0.002 | 38.0 | ○ |
| 381 | 71.9 | 2 | 22.498 | 2 | 0.1 | 1.5 | 0.002 | 38.0 | ○ |
| 382 | 74.7 | 2 | 18.798 | 2 | 1 | 1.5 | 0.002 | 38.0 | ○ |
| 383 | 72.5 | 2 | 20.898 | 3 | 0.1 | 1.5 | 0.002 | 38.0 | ○ |
| 384 | 75 | 2 | 17.498 | 3 | 1 | 1.5 | 0.002 | 38.3 | ○ |

TABLE 5-5

| No. | Cu | Pb | Zn | Sn | Al | Si | B | Apparent Zn content | Corrosion resistance |
|---|---|---|---|---|---|---|---|---|---|
| 385 | 72.6 | 2 | 22.298 | 0.1 | 1.5 | 1.5 | 0.002 | 40.0 | x |
| 386 | 74.1 | 2 | 20.298 | 0.1 | 2 | 1.5 | 0.002 | 40.0 | x |

TABLE 5-6

| No. | Cu | Pb | Zn | Sn | Al | Si | B | Apparent Zn content | Corrosion resistance |
|---|---|---|---|---|---|---|---|---|---|
| 387 | 71.2 | 2 | 24.098 | 0.2 | 1 | 1.5 | 0.002 | 40.0 | x |
| 388 | 72.7 | 2 | 22.098 | 0.2 | 1.5 | 1.5 | 0.002 | 40.0 | ○ |
| 389 | 74.2 | 2 | 20.098 | 0.2 | 2 | 1.5 | 0.002 | 40.0 | ○ |

TABLE 5-7

| No. | Cu | Pb | Zn | Sn | Al | Si | B | Apparent Zn content | Corrosion resistance |
|---|---|---|---|---|---|---|---|---|---|
| 390 | 68.6 | 2 | 27.498 | 0.3 | 0.1 | 1.5 | 0.002 | 40.0 | x |
| 391 | 69.8 | 2 | 25.898 | 0.3 | 0.5 | 1.5 | 0.002 | 40.0 | x |
| 392 | 71.3 | 2 | 23.898 | 0.3 | 1 | 1.5 | 0.002 | 40.0 | x |
| 393 | 72.8 | 2 | 21.898 | 0.3 | 1.5 | 1.5 | 0.002 | 40.0 | ○ |
| 394 | 74.3 | 2 | 19.898 | 0.3 | 2 | 1.5 | 0.002 | 40.0 | ○ |

TABLE 5-8

| No. | Cu | Pb | Zn | Sn | Al | Si | B | Apparent Zn content | Corrosion resistance |
|---|---|---|---|---|---|---|---|---|---|
| 395 | 68.6 | 2 | 27.398 | 0.4 | 0.1 | 1.5 | 0.002 | 40.0 | ○ |
| 396 | 69.8 | 2 | 25.798 | 0.4 | 0.5 | 1.5 | 0.002 | 40.0 | ○ |
| 397 | 71.3 | 2 | 23.798 | 0.4 | 1 | 1.5 | 0.002 | 40.0 | ○ |
| 398 | 74.4 | 2 | 19.698 | 0.4 | 2 | 1.5 | 0.002 | 40.0 | ○ |
| 399 | 68.7 | 2 | 27.198 | 0.5 | 0.1 | 1.5 | 0.002 | 40.0 | ○ |
| 400 | 69.9 | 2 | 25.598 | 0.5 | 0.5 | 1.5 | 0.002 | 40.0 | ○ |
| 401 | 71.4 | 2 | 23.598 | 0.5 | 1 | 1.5 | 0.002 | 40.0 | ○ |
| 402 | 74.4 | 2 | 19.598 | 0.5 | 2 | 1.5 | 0.002 | 40.0 | ○ |
| 403 | 69 | 2 | 26.398 | 1 | 0.1 | 1.5 | 0.002 | 40.0 | ○ |
| 404 | 70.2 | 2 | 24.798 | 1 | 0.5 | 1.5 | 0.002 | 40.0 | ○ |
| 405 | 71.7 | 2 | 22.798 | 1 | 1 | 1.5 | 0.002 | 40.0 | ○ |
| 406 | 74.7 | 2 | 18.798 | 1 | 2 | 1.5 | 0.002 | 40.0 | ○ |
| 407 | 69.3 | 2 | 25.598 | 1.5 | 0.1 | 1.5 | 0.002 | 40.0 | ○ |
| 408 | 70.5 | 2 | 23.998 | 1.5 | 0.5 | 1.5 | 0.002 | 40.0 | ○ |
| 409 | 72 | 2 | 21.998 | 1.5 | 1 | 1.5 | 0.002 | 40.0 | ○ |
| 410 | 69.6 | 2 | 24.798 | 2 | 0.1 | 1.5 | 0.002 | 40.0 | ○ |
| 411 | 72.3 | 2 | 21.198 | 2 | 1 | 1.5 | 0.002 | 40.0 | ○ |
| 412 | 73.8 | 2 | 19.198 | 2 | 1.5 | 1.5 | 0.002 | 40.0 | ○ |
| 413 | 70.2 | 2 | 23.198 | 3 | 0.1 | 1.5 | 0.002 | 40.0 | ○ |
| 414 | 72.9 | 2 | 19.598 | 3 | 1 | 1.5 | 0.002 | 40.0 | ○ |
| 415 | 74.4 | 2 | 17.598 | 3 | 1.5 | 1.5 | 0.002 | 40.0 | ○ |

TABLE 5-9

| No. | Cu | Pb | Zn | Sn | Al | Si | B | Apparent Zn content | Corrosion resistance |
|---|---|---|---|---|---|---|---|---|---|
| 416 | 70.3 | 2 | 24.498 | 0.2 | 1.5 | 1.5 | 0.002 | 42.0 | x |
| 417 | 68.9 | 2 | 26.298 | 0.3 | 1 | 1.5 | 0.002 | 42.0 | x |
| 418 | 67.5 | 2 | 28.098 | 0.4 | 0.5 | 1.5 | 0.002 | 42.0 | x |
| 419 | 69 | 2 | 26.098 | 0.4 | 1 | 1.5 | 0.002 | 42.0 | x |
| 420 | 70.4 | 2 | 24.198 | 0.4 | 1.5 | 1.5 | 0.002 | 42.0 | x |
| 421 | 71.9 | 2 | 22.198 | 0.4 | 2 | 1.5 | 0.002 | 42.0 | x |

TABLE 5-10

| No. | Cu | Pb | Zn | Sn | Al | Si | B | Apparent Zn content | Corrosion resistance |
|---|---|---|---|---|---|---|---|---|---|
| 422 | 66.4 | 2 | 29.498 | 0.5 | 0.1 | 1.5 | 0.002 | 42.0 | x |
| 423 | 67.6 | 2 | 27.898 | 0.5 | 0.5 | 1.5 | 0.002 | 42.0 | x |

TABLE 5-10-continued

| No. | Cu | Pb | Zn | Sn | Al | Si | B | Apparent Zn content | Corrosion resistance |
|---|---|---|---|---|---|---|---|---|---|
| 424 | 69 | 2 | 25.998 | 0.5 | 1 | 1.5 | 0.002 | 42.0 | ○ |
| 425 | 70.5 | 2 | 23.998 | 0.5 | 1.5 | 1.5 | 0.002 | 42.0 | ○ |
| 426 | 71.9 | 2 | 22.098 | 0.5 | 2 | 1.5 | 0.002 | 42.0 | ○ |

TABLE 5-11

| No. | Cu | Pb | Zn | Sn | Al | Si | B | Apparent Zn content | Corrosion resistance |
|---|---|---|---|---|---|---|---|---|---|
| 427 | 66.7 | 2 | 28.698 | 1 | 0.1 | 1.5 | 0.002 | 42.0 | ○ |
| 428 | 67.9 | 2 | 27.098 | 1 | 0.5 | 1.5 | 0.002 | 42.0 | ○ |
| 429 | 69.3 | 2 | 25.198 | 1 | 1 | 1.5 | 0.002 | 42.0 | ○ |
| 430 | 72.2 | 2 | 21.298 | 1 | 2 | 1.5 | 0.002 | 42.0 | ○ |
| 431 | 67.3 | 2 | 27.098 | 2 | 0.1 | 1.5 | 0.002 | 42.0 | ○ |
| 432 | 69.9 | 2 | 23.598 | 2 | 1 | 1.5 | 0.002 | 42.0 | ○ |
| 433 | 71.4 | 2 | 21.598 | 2 | 1.5 | 1.5 | 0.002 | 42.0 | ○ |
| 434 | 72.8 | 2 | 19.698 | 2 | 2 | 1.5 | 0.002 | 42.0 | ○ |
| 435 | 67.9 | 2 | 25.498 | 3 | 0.1 | 1.5 | 0.002 | 42.0 | ○ |
| 436 | 70.5 | 2 | 21.998 | 3 | 1 | 1.5 | 0.002 | 42.0 | ○ |
| 437 | 73.4 | 2 | 18.098 | 3 | 2 | 1.5 | 0.002 | 42.0 | ○ |

TABLE 5-12

| No. | Cu | Pb | Zn | Sn | Al | Si | B | Apparent Zn content | Corrosion resistance |
|---|---|---|---|---|---|---|---|---|---|
| 438 | 67.9 | 2 | 26.898 | 0.2 | 1.5 | 1.5 | 0.002 | 44.0 | x |
| 439 | 69.3 | 2 | 24.998 | 0.2 | 2 | 1.5 | 0.002 | 44.0 | x |

TABLE 5-13

| No. | Cu | Pb | Zn | Sn | Al | Si | B | Apparent Zn content | Corrosion resistance |
|---|---|---|---|---|---|---|---|---|---|
| 440 | 65.1 | 2 | 30.598 | 0.3 | 0.5 | 1.5 | 0.002 | 44.0 | x |
| 441 | 66.5 | 2 | 28.698 | 0.3 | 1 | 1.5 | 0.002 | 44.0 | x |

TABLE 5-13-continued

| No. | Cu | Pb | Zn | Sn | Al | Si | B | Apparent Zn content | Corrosion resistance |
|---|---|---|---|---|---|---|---|---|---|
| 442 | 67.9 | 2 | 26.798 | 0.3 | 1.5 | 1.5 | 0.002 | 44.0 | ○ |
| 443 | 69.3 | 2 | 24.898 | 0.3 | 2 | 1.5 | 0.002 | 44.0 | ○ |

TABLE 5-14

| No. | Cu | Pb | Zn | Sn | Al | Si | B | Apparent Zn content | Corrosion resistance |
|---|---|---|---|---|---|---|---|---|---|
| 444 | 64.1 | 2 | 31.898 | 0.4 | 0.1 | 1.5 | 0.002 | 44.0 | x |
| 445 | 65.2 | 2 | 30.398 | 0.4 | 0.5 | 1.5 | 0.002 | 44.0 | ○ |
| 446 | 66.6 | 2 | 28.498 | 0.4 | 1 | 1.5 | 0.002 | 44.0 | ○ |
| 447 | 68 | 2 | 26.598 | 0.4 | 1.5 | 1.5 | 0.002 | 44.0 | ○ |
| 448 | 69.4 | 2 | 24.698 | 0.4 | 2 | 1.5 | 0.002 | 44.0 | ○ |

TABLE 5-15

| No. | Cu | Pb | Zn | Sn | Al | Si | B | Apparent Zn content | Corrosion resistance |
|---|---|---|---|---|---|---|---|---|---|
| 449 | 64.1 | 2 | 31.798 | 0.5 | 0.1 | 1.5 | 0.002 | 44.0 | ○ |
| 450 | 65.2 | 2 | 30.298 | 0.5 | 0.5 | 1.5 | 0.002 | 44.0 | ○ |
| 451 | 66.6 | 2 | 28.398 | 0.5 | 1 | 1.5 | 0.002 | 44.0 | ○ |
| 452 | 68 | 2 | 26.498 | 0.5 | 1.5 | 1.5 | 0.002 | 44.0 | ○ |
| 453 | 69.4 | 2 | 24.598 | 0.5 | 2 | 1.5 | 0.002 | 44.0 | ○ |
| 454 | 64.4 | 2 | 30.998 | 1 | 0.1 | 1.5 | 0.002 | 44.0 | ○ |
| 455 | 65.5 | 2 | 29.498 | 1 | 0.5 | 1.5 | 0.002 | 44.0 | ○ |
| 456 | 66.9 | 2 | 27.598 | 1 | 1 | 1.5 | 0.002 | 44.0 | ○ |
| 457 | 69.7 | 2 | 23.798 | 1 | 2 | 1.5 | 0.002 | 44.0 | ○ |
| 458 | 65 | 2 | 29.398 | 2 | 0.1 | 1.5 | 0.002 | 44.0 | ○ |
| 459 | 66.1 | 2 | 27.898 | 2 | 0.5 | 1.5 | 0.002 | 44.0 | ○ |
| 460 | 67.5 | 2 | 25.998 | 2 | 1 | 1.5 | 0.002 | 44.0 | ○ |
| 461 | 70.3 | 2 | 22.198 | 2 | 2 | 1.5 | 0.002 | 44.0 | ○ |
| 462 | 65.5 | 2 | 27.898 | 3 | 0.1 | 1.5 | 0.002 | 44.0 | ○ |
| 463 | 66.6 | 2 | 26.398 | 3 | 0.5 | 1.5 | 0.002 | 44.0 | ○ |
| 464 | 68 | 2 | 24.498 | 3 | 1 | 1.5 | 0.002 | 44.0 | ○ |
| 465 | 70.9 | 2 | 20.598 | 3 | 2 | 1.5 | 0.002 | 44.0 | ○ |

TABLE 6

| No. | Cu | Pb | Bi | Zn | Sn | Al | Si | B | Apparent Zn content | Corrosion resistance |
|---|---|---|---|---|---|---|---|---|---|---|
| 466 | 62.50 | 0 | 0.50 | 33.80 | 3.00 | 0.10 | 0.10 | 0.0020 | 40.0 | ○ |
| 467 | 63.10 | 0 | 0.50 | 33.80 | 2.00 | 0.50 | 0.10 | 0.0020 | 40.0 | ○ |
| 468 | 64.00 | 0 | 0.50 | 33.40 | 1.00 | 1.00 | 0.10 | 0.0020 | 40.0 | ○ |
| 469 | 65.20 | 0 | 0.50 | 32.20 | 0.50 | 1.50 | 0.10 | 0.0020 | 40.0 | ○ |
| 470 | 66.50 | 0 | 0.50 | 30.80 | 0.10 | 2.00 | 0.10 | 0.0020 | 40.0 | x |
| 471 | 66.50 | 0 | 0.50 | 30.70 | 0.20 | 2.00 | 0.10 | 0.0020 | 40.0 | ○ |
| 472 | 64.70 | 0 | 0.50 | 31.20 | 3.00 | 0.10 | 0.50 | 0.0020 | 40.0 | ○ |
| 473 | 65.30 | 0 | 0.50 | 31.20 | 2.00 | 0.50 | 0.50 | 0.0020 | 40.0 | ○ |
| 474 | 66.20 | 0 | 0.50 | 30.80 | 1.00 | 1.00 | 0.50 | 0.0020 | 40.0 | ○ |
| 475 | 67.40 | 0 | 0.50 | 29.60 | 0.50 | 1.50 | 0.50 | 0.0020 | 40.0 | ○ |
| 476 | 68.60 | 0 | 0.50 | 28.30 | 0.10 | 2.00 | 0.50 | 0.0020 | 40.0 | x |
| 477 | 68.70 | 0 | 0.50 | 28.10 | 0.20 | 2.00 | 0.50 | 0.0020 | 40.0 | ○ |
| 478 | 67.40 | 0 | 0.50 | 28.00 | 3.00 | 0.10 | 1.00 | 0.0020 | 40.0 | ○ |
| 479 | 68.00 | 0 | 0.50 | 28.00 | 2.00 | 0.50 | 1.00 | 0.0020 | 40.0 | ○ |
| 480 | 68.90 | 0 | 0.50 | 27.60 | 1.00 | 1.00 | 1.00 | 0.0020 | 40.0 | ○ |
| 481 | 70.10 | 0 | 0.50 | 26.40 | 0.50 | 1.50 | 1.00 | 0.0020 | 40.0 | ○ |
| 482 | 71.30 | 0 | 0.50 | 25.10 | 0.10 | 2.00 | 1.00 | 0.0020 | 40.0 | x |
| 483 | 71.40 | 0 | 0.50 | 24.90 | 0.20 | 2.00 | 1.00 | 0.0020 | 40.0 | ○ |
| 484 | 70.10 | 0 | 0.50 | 24.80 | 3.00 | 0.10 | 1.50 | 0.0020 | 40.0 | ○ |
| 485 | 70.70 | 0 | 0.50 | 24.80 | 2.00 | 0.50 | 1.50 | 0.0020 | 40.0 | ○ |
| 486 | 71.60 | 0 | 0.50 | 24.40 | 1.00 | 1.00 | 1.50 | 0.0020 | 40.0 | ○ |
| 487 | 72.80 | 0 | 0.50 | 23.20 | 0.50 | 1.50 | 1.50 | 0.0020 | 40.0 | ○ |

TABLE 6-continued

| No. | Cu | Pb | Bi | Zn | Sn | Al | Si | B | Apparent Zn content | Corrosion resistance |
|---|---|---|---|---|---|---|---|---|---|---|
| 488 | 74.00 | 0 | 0.50 | 21.90 | 0.10 | 2.00 | 1.50 | 0.0020 | 40.0 | x |
| 489 | 74.10 | 0 | 0.50 | 21.70 | 0.20 | 2.00 | 1.50 | 0.0020 | 40.0 | ○ |

TABLE 7-1

| No. | Cu | Pb | Bi | Zn | Sn | Al | Si | B | Mn | Ti | Mg | P | Rare earth metal | Apparent Zn content | Corrosion resistance | Casting crack resistance |
|---|---|---|---|---|---|---|---|---|---|---|---|---|---|---|---|---|
| 490 | 63.80 | 1.00 | 0 | 33.39 | 0.50 | 1.00 | 0.10 | 0.0015 | 0.10 | 0 | 0 | 0.005 | 0 | 40.0 | ○ | ○ |
| 491 | 63.80 | 1.00 | 0 | 33.29 | 0.50 | 1.00 | 0.10 | 0.0015 | 0.20 | 0 | 0 | 0.005 | 0 | 40.0 | ○ | ○ |
| 492 | 63.80 | 1.00 | 0 | 33.19 | 0.50 | 1.00 | 0.10 | 0.0015 | 0.30 | 0 | 0 | 0.005 | 0 | 40.0 | ○ | x |
| 493 | 63.80 | 1.00 | 0 | 33.24 | 0.50 | 1.00 | 0.10 | 0.0015 | 0.25 | 0 | 0 | 0.005 | 0 | 40.0 | ○ | x |
| 494 | 65.80 | 0 | 0.50 | 30.99 | 0.50 | 1.00 | 0.50 | 0.0015 | 0.10 | 0 | 0 | 0.005 | 0 | 40.0 | ○ | ○ |
| 495 | 65.80 | 0 | 0.50 | 30.89 | 0.50 | 1.00 | 0.50 | 0.0015 | 0.20 | 0 | 0 | 0.005 | 0 | 40.0 | ○ | ○ |
| 496 | 65.80 | 0 | 0.50 | 30.84 | 0.50 | 1.00 | 0.50 | 0.0015 | 0.25 | 0 | 0 | 0.005 | 0 | 40.0 | ○ | x |
| 497 | 63.80 | 1.00 | 0 | 33.48 | 0.50 | 1.00 | 0.10 | 0.0015 | 0.005 | 0.01 | 0 | 0.005 | 0 | 40.0 | ○ | ○ |
| 498 | 63.80 | 1.00 | 0 | 33.46 | 0.50 | 1.00 | 0.10 | 0.0015 | 0.005 | 0.03 | 0 | 0.005 | 0 | 40.0 | ○ | ○ |
| 499 | 63.80 | 1.00 | 0 | 33.44 | 0.50 | 1.00 | 0.10 | 0.0015 | 0.005 | 0.05 | 0 | 0.005 | 0 | 40.0 | ○ | x |
| 500 | 63.80 | 1.00 | 0 | 33.45 | 0.50 | 1.00 | 0.10 | 0.0015 | 0.005 | 0.04 | 0 | 0.005 | 0 | 40.0 | ○ | ○ |
| 501 | 65.80 | 0 | 0.50 | 31.08 | 0.50 | 1.00 | 0.50 | 0.0015 | 0.005 | 0.01 | 0 | 0.005 | 0 | 40.0 | ○ | ○ |
| 502 | 65.80 | 0 | 0.50 | 31.06 | 0.50 | 1.00 | 0.50 | 0.0015 | 0.005 | 0.03 | 0 | 0.005 | 0 | 40.0 | ○ | ○ |
| 503 | 65.80 | 0 | 0.50 | 31.05 | 0.50 | 1.00 | 0.50 | 0.0015 | 0.005 | 0.04 | 0 | 0.005 | 0 | 40.0 | ○ | ○ |

TABLE 7-2

| No. | Cu | Pb | Bi | Zn | Sn | Al | Si | B | Mn | Ti | Mg | P | Rare earth metal | Apparent Zn content | Corrosion resistance | Casting crack resistance |
|---|---|---|---|---|---|---|---|---|---|---|---|---|---|---|---|---|
| 504 | 63.90 | 1.00 | 0 | 33.29 | 0.50 | 1.00 | 0.10 | 0.0015 | 0.005 | 0 | 0.10 | 0.005 | 0 | 40.0 | ○ | ○ |
| 505 | 63.90 | 1.00 | 0 | 33.19 | 0.50 | 1.00 | 0.10 | 0.0015 | 0.005 | 0 | 0.20 | 0.005 | 0 | 40.0 | ○ | ○ |
| 506 | 64.00 | 1.00 | 0 | 32.99 | 0.50 | 1.00 | 0.10 | 0.0015 | 0.005 | 0 | 0.30 | 0.005 | 0 | 40.0 | ○ | x |
| 507 | 64.00 | 1.00 | 0 | 33.04 | 0.50 | 1.00 | 0.10 | 0.0015 | 0.005 | 0 | 0.25 | 0.005 | 0 | 40.0 | ○ | ○ |
| 508 | 65.80 | 0 | 0.50 | 30.99 | 0.50 | 1.00 | 0.50 | 0.0015 | 0.005 | 0 | 0.10 | 0.005 | 0 | 40.0 | ○ | ○ |
| 509 | 65.90 | 0 | 0.50 | 30.79 | 0.50 | 1.00 | 0.50 | 0.0015 | 0.005 | 0 | 0.20 | 0.005 | 0 | 40.0 | ○ | ○ |
| 510 | 65.90 | 0 | 0.50 | 30.74 | 0.50 | 1.00 | 0.50 | 0.0015 | 0.005 | 0 | 0.25 | 0.005 | 0 | 40.0 | ○ | ○ |
| 511 | 63.80 | 1.00 | 0 | 33.44 | 0.50 | 1.00 | 0.10 | 0.0015 | 0.005 | 0 | 0 | 0.05 | 0 | 40.0 | ○ | ○ |
| 512 | 63.80 | 1.00 | 0 | 33.39 | 0.50 | 1.00 | 0.10 | 0.0015 | 0.005 | 0 | 0 | 0.10 | 0 | 40.0 | ○ | ○ |
| 513 | 63.80 | 1.00 | 0 | 33.34 | 0.50 | 1.00 | 0.10 | 0.0015 | 0.005 | 0 | 0 | 0.15 | 0 | 40.0 | ○ | x |
| 514 | 63.80 | 1.00 | 0 | 33.36 | 0.50 | 1.00 | 0.10 | 0.0015 | 0.005 | 0 | 0 | 0.13 | 0 | 40.0 | ○ | ○ |
| 515 | 65.80 | 0 | 0.50 | 31.04 | 0.50 | 1.00 | 0.50 | 0.0015 | 0.005 | 0 | 0 | 0.05 | 0 | 40.0 | ○ | ○ |
| 516 | 65.80 | 0 | 0.50 | 30.99 | 0.50 | 1.00 | 0.50 | 0.0015 | 0.005 | 0 | 0 | 0.10 | 0 | 40.0 | ○ | ○ |
| 517 | 65.80 | 0 | 0.50 | 30.96 | 0.50 | 1.00 | 0.50 | 0.0015 | 0.005 | 0 | 0 | 0.13 | 0 | 40.0 | ○ | ○ |
| 518 | 63.80 | 1.00 | 0 | 33.48 | 0.50 | 1.00 | 0.10 | 0.0015 | 0.005 | 0 | 0 | 0.005 | 0.0050 | 40.0 | ○ | x |
| 519 | 63.80 | 1.00 | 0 | 33.48 | 0.50 | 1.00 | 0.10 | 0.0015 | 0.005 | 0 | 0 | 0.005 | 0.0040 | 40.0 | ○ | ○ |
| 520 | 63.80 | 1.00 | 0 | 33.46 | 0.50 | 1.00 | 0.10 | 0.0015 | 0.005 | 0 | 0 | 0.005 | 0.0030 | 40.0 | ○ | ○ |
| 521 | 65.80 | 0 | 0.50 | 31.09 | 0.50 | 1.00 | 0.50 | 0.0015 | 0.005 | 0 | 0 | 0.005 | 0.0030 | 40.0 | ○ | ○ |

TABLE 8-1

| No. | Cu | Sb | Pb | Bi | Zn | Sn | Fe | Ni | Al | Si | P | B | Mn | Cr | Apparent Zn content | Corrosion resistance | Casting crack resistance |
|---|---|---|---|---|---|---|---|---|---|---|---|---|---|---|---|---|---|
| 522 | 63.80 | 0.005 | 1.00 | 0.05 | 33.40 | 0.50 | 0.10 | 0.03 | 1.00 | 0.10 | 0.005 | 0.0050 | 0.005 | 0.0025 | 40.0 | ○ | ○ |
| 523 | 63.80 | 0.005 | 1.00 | 0.05 | 33.20 | 0.50 | 0.30 | 0.03 | 1.00 | 0.10 | 0.005 | 0.0050 | 0.005 | 0.0025 | 40.0 | ○ | ○ |
| 524 | 63.80 | 0.005 | 1.00 | 0.05 | 33.00 | 0.50 | 0.50 | 0.03 | 1.00 | 0.10 | 0.005 | 0.0050 | 0.005 | 0.0025 | 40.0 | ○ | ○ |
| 525 | 63.70 | 0.005 | 1.00 | 0.05 | 32.60 | 0.50 | 1.00 | 0.03 | 1.00 | 0.10 | 0.005 | 0.0050 | 0.005 | 0.0025 | 40.0 | ○ | ○ |
| 526 | 65.80 | 0.005 | 0.05 | 0.50 | 31.50 | 0.50 | 0.10 | 0.03 | 1.00 | 0.50 | 0.005 | 0.0050 | 0.005 | 0.0025 | 40.0 | ○ | ○ |
| 527 | 65.80 | 0.005 | 0.05 | 0.50 | 31.30 | 0.50 | 0.30 | 0.03 | 1.00 | 0.50 | 0.005 | 0.0050 | 0.005 | 0.0025 | 40.0 | ○ | ○ |
| 528 | 65.80 | 0.005 | 0.05 | 0.50 | 31.10 | 0.50 | 0.50 | 0.03 | 1.00 | 0.50 | 0.005 | 0.0050 | 0.005 | 0.0025 | 40.0 | ○ | ○ |
| 529 | 65.80 | 0.005 | 0.05 | 0.50 | 30.60 | 0.50 | 1.00 | 0.03 | 1.00 | 0.50 | 0.005 | 0.0050 | 0.005 | 0.0025 | 40.0 | ○ | ○ |

TABLE 8-1-continued

| No. | Cu | Sb | Pb | Bi | Zn | Sn | Fe | Ni | Al | Si | P | B | Mn | Cr | Apparent Zn content | Corrosion resistance | Casting crack resistance |
|---|---|---|---|---|---|---|---|---|---|---|---|---|---|---|---|---|---|
| 530 | 63.80 | 0.05 | 1.00 | 0.05 | 33.44 | 0.50 | 0.02 | 0.03 | 1.00 | 0.10 | 0.005 | 0.0050 | 0.005 | 0.0025 | 40.0 | ○ | ○ |
| 531 | 63.80 | 0.10 | 1.00 | 0.05 | 33.39 | 0.50 | 0.02 | 0.03 | 1.00 | 0.10 | 0.005 | 0.0050 | 0.005 | 0.0025 | 40.0 | ○ | ○ |
| 532 | 63.80 | 0.20 | 1.00 | 0.05 | 33.29 | 0.50 | 0.02 | 0.03 | 1.00 | 0.10 | 0.005 | 0.0050 | 0.005 | 0.0025 | 40.0 | ○ | x |
| 533 | 63.80 | 0.20 | 1.00 | 0.05 | 33.26 | 0.50 | 0.02 | 0.03 | 1.00 | 0.10 | 0.005 | 0.0300 | 0.005 | 0.0025 | 40.0 | ○ | ○ |
| 534 | 65.80 | 0.05 | 0.05 | 0.50 | 31.54 | 0.50 | 0.02 | 0.03 | 1.00 | 0.50 | 0.005 | 0.0050 | 0.005 | 0.0025 | 40.0 | ○ | ○ |
| 535 | 65.80 | 0.10 | 0.05 | 0.50 | 31.49 | 0.50 | 0.02 | 0.03 | 1.00 | 0.50 | 0.005 | 0.0050 | 0.005 | 0.0025 | 40.0 | ○ | ○ |
| 536 | 65.80 | 0.20 | 0.05 | 0.50 | 31.39 | 0.50 | 0.02 | 0.03 | 1.00 | 0.50 | 0.005 | 0.0050 | 0.005 | 0.0025 | 40.0 | ○ | x |
| 537 | 65.80 | 0.20 | 0.05 | 0.50 | 31.36 | 0.50 | 0.02 | 0.03 | 1.00 | 0.50 | 0.005 | 0.0300 | 0.005 | 0.0025 | 40.0 | ○ | ○ |

TABLE 8-2

| No. | Cu | Sb | Pb | Bi | Zn | Sn | Fe | Ni | Al | Si | P | B | Mn | Cr | Apparent Zn content | Corrosion resistance | Casting crack resistance |
|---|---|---|---|---|---|---|---|---|---|---|---|---|---|---|---|---|---|
| 538 | 67.90 | 0.005 | 0.05 | 2.00 | 27.31 | 0.50 | 0.02 | 0.20 | 1.00 | 1.00 | 0.005 | 0.0025 | 0.005 | 0.0025 | 40.0 | ○ | ○ |
| 539 | 67.50 | 0.005 | 0.05 | 2.00 | 27.41 | 0.50 | 0.02 | 0.50 | 1.00 | 1.00 | 0.005 | 0.0025 | 0.005 | 0.0025 | 40.0 | ○ | ○ |
| 540 | 67.20 | 0.005 | 0.05 | 2.00 | 27.51 | 0.50 | 0.02 | 0.70 | 1.00 | 1.00 | 0.005 | 0.0025 | 0.005 | 0.0025 | 40.0 | ○ | ○ |
| 541 | 66.80 | 0.005 | 0.05 | 2.00 | 27.61 | 0.50 | 0.02 | 1.00 | 1.00 | 1.00 | 0.005 | 0.0025 | 0.005 | 0.0025 | 40.0 | ○ | x |
| 542 | 64.00 | 0.005 | 0.05 | 2.00 | 32.51 | 0.25 | 0.02 | 0.20 | 0.20 | 0.75 | 0.005 | 0 | 0.005 | 0.0025 | 40.0 | ○ | ○ |
| 543 | 63.60 | 0.005 | 0.05 | 2.00 | 32.61 | 0.25 | 0.02 | 0.50 | 0.20 | 0.75 | 0.005 | 0 | 0.005 | 0.0025 | 40.0 | ○ | x |
| 544 | 63.40 | 0.005 | 0.05 | 2.00 | 32.61 | 0.25 | 0.02 | 0.70 | 0.20 | 0.75 | 0.005 | 0 | 0.005 | 0.0025 | 40.0 | ○ | x |
| 545 | 63.80 | 0.005 | 1.00 | 0.05 | 33.38 | 0.50 | 0.02 | 0.03 | 1.00 | 0.10 | 0.005 | 0.0050 | 0.005 | 0.10 | 40.0 | ○ | ○ |
| 546 | 63.80 | 0.005 | 1.00 | 0.05 | 33.18 | 0.50 | 0.02 | 0.03 | 1.00 | 0.10 | 0.005 | 0.0050 | 0.005 | 0.30 | 40.0 | ○ | ○ |
| 547 | 63.80 | 0.005 | 1.00 | 0.05 | 32.98 | 0.50 | 0.02 | 0.03 | 1.00 | 0.10 | 0.005 | 0.0050 | 0.005 | 0.50 | 40.0 | ○ | ○ |
| 548 | 65.80 | 0.005 | 0.05 | 0.50 | 31.48 | 0.50 | 0.02 | 0.03 | 1.00 | 0.50 | 0.005 | 0.0050 | 0.005 | 0.10 | 40.0 | ○ | ○ |
| 549 | 65.80 | 0.005 | 0.05 | 0.50 | 31.28 | 0.50 | 0.02 | 0.03 | 1.00 | 0.50 | 0.005 | 0.0050 | 0.005 | 0.30 | 40.0 | ○ | ○ |
| 550 | 65.80 | 0.005 | 0.05 | 0.50 | 31.08 | 0.50 | 0.02 | 0.03 | 1.00 | 0.50 | 0.005 | 0.0050 | 0.005 | 0.50 | 40.0 | ○ | ○ |
| 551 | 63.80 | 0.005 | 1.00 | 0.10 | 33.43 | 0.50 | 0.02 | 0.03 | 1.00 | 0.50 | 0.005 | 0.0100 | 0.005 | 0.10 | 40.0 | ○ | ○ |
| 552 | 63.70 | 0.005 | 1.00 | 0.30 | 33.33 | 0.50 | 0.02 | 0.03 | 1.00 | 0.50 | 0.005 | 0.0100 | 0.005 | 0.30 | 40.0 | ○ | ○ |
| 553 | 63.70 | 0.005 | 1.00 | 0.50 | 33.13 | 0.50 | 0.02 | 0.03 | 1.00 | 0.50 | 0.005 | 0.0100 | 0.005 | 0.50 | 40.0 | ○ | ○ |
| 554 | 65.70 | 0.005 | 0.10 | 1.00 | 31.03 | 0.50 | 0.02 | 0.03 | 1.00 | 0.50 | 0.005 | 0.0100 | 0.005 | 0.10 | 40.0 | ○ | ○ |
| 555 | 65.70 | 0.005 | 0.30 | 1.00 | 30.63 | 0.50 | 0.02 | 0.03 | 1.00 | 0.50 | 0.005 | 0.0100 | 0.005 | 0.30 | 40.0 | ○ | ○ |
| 556 | 65.70 | 0.005 | 0.50 | 1.00 | 30.23 | 0.50 | 0.02 | 0.03 | 1.00 | 0.50 | 0.005 | 0.0100 | 0.005 | 0.50 | 40.0 | ○ | ○ |

TABLE 9-1

| No. | Cu | Sb | Pb | Bi | Zn | Sn | Fe | Ni | Al | Si | P | B | Mn | Cr | Apparent Zn content | Corrosion resistance | Casting crack resistance |
|---|---|---|---|---|---|---|---|---|---|---|---|---|---|---|---|---|---|
| 557 | 67.00 | 0.005 | 1.90 | 0 | 28.48 | 0.55 | 0.02 | 0.03 | 2.00 | 0 | 0.005 | 0.0015 | 0.005 | 0.0025 | 39.4 | ○ | ○ |
| 558 | 67.00 | 0.005 | 1.90 | 0 | 28.63 | 0.55 | 0.02 | 0.03 | 1.50 | 0.35 | 0.005 | 0.0015 | 0.005 | 0.0025 | 39.7 | ○ | ○ |
| 559 | 66.50 | 0.005 | 1.90 | 0 | 29.48 | 0.55 | 0.02 | 0.03 | 1.00 | 0.50 | 0.005 | 0.0015 | 0.005 | 0.0025 | 39.5 | ○ | ○ |
| 560 | 66.00 | 0.005 | 1.90 | 0 | 30.18 | 0.50 | 0.02 | 0.03 | 1.00 | 0.35 | 0.005 | 0.0015 | 0.005 | 0.0025 | 39.2 | ○ | ○ |
| 561 | 65.20 | 0.005 | 1.90 | 0 | 30.28 | 0.55 | 0.02 | 0.03 | 2.00 | 0 | 0.005 | 0.0015 | 0.005 | 0.0025 | 41.0 | ○ | ○ |
| 562 | 66.50 | 0.005 | 1.90 | 0 | 28.88 | 0.55 | 0.02 | 0.03 | 2.00 | 0.10 | 0.005 | 0.0015 | 0.005 | 0.0025 | 40.3 | ○ | ○ |
| 563 | 65.50 | 0.005 | 1.90 | 0 | 30.48 | 0.55 | 0.02 | 0.03 | 1.50 | 0 | 0.005 | 0.0015 | 0.005 | 0.0025 | 39.3 | ○ | ○ |
| 564 | 66.00 | 0.005 | 1.90 | 0 | 29.88 | 0.55 | 0.02 | 0.03 | 1.50 | 0.10 | 0.005 | 0.0015 | 0.005 | 0.0025 | 39.4 | ○ | ○ |
| 565 | 67.00 | 0.005 | 1.90 | 0 | 29.18 | 0.55 | 0.02 | 0.03 | 0.40 | 0.90 | 0.005 | 0.0015 | 0.005 | 0.0025 | 39.4 | ○ | ○ |
| 566 | 64.50 | 0.005 | 1.90 | 0 | 31.88 | 0.55 | 0.02 | 0.03 | 1.00 | 0.10 | 0.005 | 0.0015 | 0.005 | 0.0025 | 39.4 | ○ | ○ |
| 567 | 66.00 | 0.005 | 1.90 | 0 | 30.03 | 0.70 | 0.02 | 0.03 | 0.40 | 0.90 | 0.005 | 0.0015 | 0.005 | 0.0025 | 40.4 | ○ | ○ |
| 568 | 63.50 | 0.005 | 1.90 | 0 | 33.18 | 0.55 | 0.02 | 0.03 | 0.70 | 0.10 | 0.005 | 0.0015 | 0.005 | 0.0025 | 39.5 | ○ | ○ |
| 569 | 65.00 | 0.005 | 1.90 | 0 | 31.23 | 0.70 | 0.02 | 0.03 | 0.30 | 0.80 | 0.005 | 0.0015 | 0.005 | 0.0025 | 40.5 | ○ | ○ |
| 570 | 63.60 | 0.005 | 1.90 | 0 | 32.78 | 0.55 | 0.02 | 0.03 | 1.00 | 0.10 | 0.005 | 0.0015 | 0.005 | 0.0025 | 40.2 | ○ | ○ |
| 571 | 62.80 | 0.005 | 1.90 | 0 | 33.58 | 0.55 | 0.02 | 0.03 | 1.00 | 0.10 | 0.005 | 0.0015 | 0.005 | 0.0025 | 41.0 | ○ | ○ |
| 572 | 63.20 | 0.005 | 1.90 | 0 | 33.18 | 0.55 | 0.02 | 0.03 | 1.00 | 0.10 | 0.005 | 0.0015 | 0.005 | 0.0025 | 40.6 | ○ | ○ |
| 573 | 63.90 | 0.005 | 1.90 | 0 | 32.23 | 0.55 | 0.02 | 0.03 | 1.25 | 0.10 | 0.005 | 0.0015 | 0.005 | 0.0025 | 40.6 | ○ | ○ |
| 574 | 64.70 | 0.005 | 1.90 | 0 | 31.18 | 0.55 | 0.02 | 0.03 | 1.50 | 0.10 | 0.005 | 0.0015 | 0.005 | 0.0025 | 40.6 | ○ | ○ |
| 575 | 62.70 | 0.005 | 1.90 | 0 | 33.78 | 0.55 | 0.02 | 0.03 | 1.00 | 0 | 0.005 | 0.0015 | 0.005 | 0.0025 | 40.6 | ○ | ○ |
| 576 | 63.10 | 0.005 | 1.90 | 0 | 33.48 | 0.35 | 0.02 | 0.03 | 1.00 | 0.10 | 0.005 | 0.0015 | 0.005 | 0.0025 | 40.6 | ○ | ○ |
| 577 | 63.30 | 0.005 | 1.90 | 0 | 32.88 | 0.75 | 0.02 | 0.03 | 1.00 | 0.10 | 0.005 | 0.0015 | 0.005 | 0.0025 | 40.6 | ○ | ○ |
| 578 | 64.30 | 0.005 | 1.90 | 0 | 31.88 | 0.55 | 0.02 | 0.03 | 1.00 | 0.30 | 0.005 | 0.0015 | 0.005 | 0.0025 | 40.6 | ○ | ○ |
| 579 | 65.30 | 0.005 | 1.90 | 0 | 30.68 | 0.55 | 0.02 | 0.03 | 1.00 | 0.50 | 0.005 | 0.0015 | 0.005 | 0.0025 | 40.6 | ○ | ○ |
| 580 | 63.60 | 0.005 | 1.90 | 0 | 32.63 | 0.50 | 0.02 | 0.03 | 1.10 | 0.10 | 0.005 | 0.0015 | 0.005 | 0.0025 | 40.5 | ○ | ○ |
| 581 | 64.50 | 0.005 | 1.90 | 0 | 31.63 | 0.35 | 0.02 | 0.03 | 1.45 | 0.10 | 0.005 | 0.0015 | 0.005 | 0.0025 | 40.5 | ○ | ○ |
| 582 | 65.60 | 0.005 | 1.90 | 0 | 30.23 | 1.00 | 0.02 | 0.03 | 0.30 | 0.90 | 0.005 | 0.0015 | 0.005 | 0.0025 | 40.6 | ○ | ○ |

TABLE 9-1-continued

| No. | Cu | Sb | Pb | Bi | Zn | Sn | Fe | Ni | Al | Si | P | B | Mn | Cr | Apparent Zn content | Corrosion resistance | Casting crack resistance |
|---|---|---|---|---|---|---|---|---|---|---|---|---|---|---|---|---|---|
| 583 | 65.80 | 0.005 | 1.90 | 0 | 29.73 | 1.30 | 0.02 | 0.03 | 0.30 | 0.90 | 0.005 | 0.0015 | 0.005 | 0.0025 | 40.6 | ○ | ○ |
| 584 | 63.10 | 0.005 | 1.90 | 0 | 33.48 | 0.50 | 0.02 | 0.03 | 0.75 | 0.10 | 0.005 | 0.0015 | 0.005 | 0.0025 | 40.0 | ○ | ○ |
| 585 | 64.80 | 0.010 | 2.00 | 0 | 31.40 | 0.68 | 0.03 | 0.05 | 1.05 | 0.05 | 0.010 | 0.0010 | 0.010 | 0.0050 | 39.0 | ○ | ○ |
| 586 | 63.80 | 0 | 1.80 | 0 | 32.78 | 0.62 | 0 | 0 | 0.95 | 0.15 | 0 | 0.0010 | 0 | 0 | 40.2 | ○ | ○ |
| 587 | 64.30 | 0.005 | 1.90 | 0 | 32.08 | 0.66 | 0.02 | 0.03 | 1.00 | 0.10 | 0.005 | 0.0015 | 0.005 | 0.0025 | 39.6 | ○ | ○ |
| 588 | 66.50 | 0.010 | 2.00 | 0 | 29.35 | 0.73 | 0.03 | 0.05 | 0.45 | 0.85 | 0.010 | 0.0010 | 0.010 | 0.0050 | 39.8 | ○ | ○ |
| 589 | 65.50 | 0 | 1.80 | 0 | 30.73 | 0.67 | 0 | 0 | 0.35 | 0.95 | 0 | 0.0010 | 0 | 0 | 41.0 | ○ | ○ |
| 590 | 66.00 | 0.005 | 1.90 | 0 | 30.03 | 0.70 | 0.02 | 0.03 | 0.40 | 0.90 | 0.005 | 0.0015 | 0.005 | 0.0025 | 40.4 | ○ | ○ |
| 591 | 64.30 | 0.005 | 0.20 | 0 | 33.78 | 0.66 | 0.02 | 0.03 | 1.00 | 0.10 | 0.005 | 0.0015 | 0.005 | 0.0025 | 39.6 | ○ | ○ |
| 592 | 64.30 | 0.005 | 0.10 | 0 | 33.88 | 0.55 | 0.02 | 0.03 | 1.00 | 0.10 | 0.005 | 0.0015 | 0.005 | 0.0025 | 39.6 | ○ | ○ |
| 593 | 63.90 | 0.005 | 0.20 | 0 | 34.38 | 0.45 | 0.02 | 0.03 | 0.90 | 0.10 | 0.005 | 0.0015 | 0.005 | 0.0025 | 39.6 | ○ | ○ |
| 594 | 63.30 | 0.005 | 0.20 | 0 | 36.13 | 0.40 | 0.02 | 0.03 | 0.70 | 0.10 | 0.005 | 0.0015 | 0.005 | 0.0025 | 39.6 | ○ | ○ |
| 595 | 63.70 | 0.005 | 0.20 | 0 | 34.63 | 0.40 | 0.02 | 0.03 | 0.90 | 0.10 | 0.005 | 0.0015 | 0.005 | 0.0025 | 39.8 | ○ | ○ |
| 596 | 63.70 | 0.005 | 0.10 | 0 | 34.73 | 0.40 | 0.02 | 0.03 | 0.90 | 0.10 | 0.005 | 0.0015 | 0.005 | 0.0025 | 39.8 | ○ | ○ |
| 597 | 64.30 | 0.005 | 0.05 | 0 | 33.93 | 0.55 | 0.02 | 0.03 | 1.00 | 0.10 | 0.005 | 0.0015 | 0.005 | 0.0025 | 39.6 | ○ | ○ |
| 598 | 64.20 | 0.005 | 0.10 | 0.10 | 33.88 | 0.55 | 0.02 | 0.03 | 1.00 | 0.10 | 0.005 | 0.0015 | 0.005 | 0.0025 | 39.6 | ○ | ○ |

20

TABLE 9-2

| No. | Cu | Sb | Pb | Bi | Zn | Sn | Fe | Ni | Al | Si | P | B | Mn | Cr | Apparent Zn content | Corrosion resistance | Casting crack resistance |
|---|---|---|---|---|---|---|---|---|---|---|---|---|---|---|---|---|---|
| 599 | 68.00 | 0.005 | 0.05 | 1.25 | 27.58 | 0.70 | 0.02 | 0.03 | 1.50 | 0.85 | 0.005 | 0.0015 | 0.005 | 0.0025 | 41.0 | ○ | ○ |
| 600 | 67.50 | 0.005 | 0.05 | 1.25 | 28.63 | 0.50 | 0.02 | 0.03 | 1.50 | 0.50 | 0.005 | 0.0015 | 0.005 | 0.0025 | 39.7 | ○ | ○ |
| 601 | 68.00 | 0.005 | 0.05 | 1.25 | 28.03 | 0.55 | 0.02 | 0.03 | 1.25 | 0.80 | 0.005 | 0.0015 | 0.005 | 0.0025 | 40.1 | ○ | ○ |
| 602 | 67.50 | 0.005 | 0.05 | 1.25 | 28.63 | 0.55 | 0.02 | 0.03 | 1.00 | 0.85 | 0.005 | 0.0015 | 0.005 | 0.0025 | 40.1 | ○ | ○ |
| 603 | 67.00 | 0.005 | 0.05 | 1.25 | 29.38 | 0.55 | 0.02 | 0.03 | 1.00 | 0.70 | 0.005 | 0.0015 | 0.005 | 0.0025 | 39.8 | ○ | ○ |
| 604 | 67.50 | 0.005 | 0.05 | 1.25 | 28.38 | 0.55 | 0.02 | 0.03 | 1.50 | 0.70 | 0.005 | 0.0015 | 0.005 | 0.0025 | 40.7 | ○ | ○ |
| 605 | 67.00 | 0.005 | 0.05 | 1.25 | 29.53 | 0.50 | 0.02 | 0.03 | 1.00 | 0.60 | 0.005 | 0.0015 | 0.005 | 0.0025 | 39.3 | ○ | ○ |
| 606 | 67.00 | 0.005 | 0.05 | 1.25 | 29.33 | 0.45 | 0.02 | 0.03 | 1.20 | 0.65 | 0.005 | 0.0015 | 0.005 | 0.0025 | 40.0 | ○ | ○ |
| 607 | 65.60 | 0.005 | 0.05 | 1.25 | 30.78 | 0.55 | 0.02 | 0.03 | 1.00 | 0.70 | 0.005 | 0.0015 | 0.005 | 0.0025 | 41.0 | ○ | ○ |
| 608 | 67.00 | 0.005 | 0.05 | 1.25 | 29.58 | 0.55 | 0.02 | 0.03 | 0.50 | 0.90 | 0.005 | 0.0015 | 0.005 | 0.0025 | 39.4 | ○ | ○ |
| 609 | 64.20 | 0.005 | 0.05 | 1.25 | 32.73 | 0.55 | 0.02 | 0.03 | 0.45 | 0.70 | 0.005 | 0.0015 | 0.005 | 0.0025 | 40.8 | ○ | ○ |
| 610 | 69.20 | 0.005 | 0.05 | 1.25 | 26.33 | 0.25 | 0.02 | 0.03 | 2.00 | 0.85 | 0.005 | 0.0015 | 0.005 | 0.0025 | 41.0 | ○ | ○ |
| 611 | 66.00 | 0.005 | 0.05 | 1.25 | 30.98 | 0.65 | 0.02 | 0.03 | 0.30 | 0.80 | 0.005 | 0.0015 | 0.005 | 0.0025 | 39.3 | ○ | ○ |
| 612 | 65.70 | 0.005 | 0.05 | 1.25 | 30.53 | 0.70 | 0.02 | 0.03 | 1.00 | 0.70 | 0.005 | 0.0015 | 0.005 | 0.0025 | 41.0 | ○ | ○ |
| 613 | 67.00 | 0.005 | 0.05 | 1.25 | 29.58 | 0.70 | 0.02 | 0.03 | 0.45 | 0.90 | 0.005 | 0.0015 | 0.005 | 0.0025 | 39.4 | ○ | ○ |
| 614 | 65.00 | 0.005 | 0.05 | 1.25 | 31.60 | 0.63 | 0.02 | 0.03 | 0.70 | 0.70 | 0.005 | 0.0015 | 0.005 | 0.0025 | 40.8 | ○ | ○ |
| 615 | 66.00 | 0.005 | 0.05 | 1.25 | 30.83 | 0.70 | 0.02 | 0.03 | 0.30 | 0.80 | 0.005 | 0.0015 | 0.005 | 0.0025 | 39.4 | ○ | ○ |
| 616 | 66.00 | 0.005 | 0.05 | 1.25 | 30.78 | 0.55 | 0.02 | 0.03 | 0.50 | 0.80 | 0.005 | 0.0015 | 0.005 | 0.0025 | 39.8 | ○ | ○ |
| 617 | 65.30 | 0.005 | 0.05 | 1.25 | 31.78 | 0.55 | 0.02 | 0.03 | 0.30 | 0.70 | 0.005 | 0.0015 | 0.005 | 0.0025 | 39.4 | ○ | ○ |
| 618 | 67.90 | 0.005 | 0.05 | 1.25 | 28.78 | 0.55 | 0.02 | 0.03 | 0.50 | 0.90 | 0.005 | 0.0015 | 0.005 | 0.0025 | 38.6 | ○ | ○ |
| 619 | 66.10 | 0.005 | 0.05 | 1.25 | 30.58 | 0.55 | 0.02 | 0.03 | 0.50 | 0.90 | 0.005 | 0.0015 | 0.005 | 0.0025 | 40.2 | ○ | ○ |
| 620 | 65.20 | 0.005 | 0.05 | 1.25 | 31.48 | 0.55 | 0.02 | 0.03 | 0.50 | 0.90 | 0.005 | 0.0015 | 0.005 | 0.0025 | 41.0 | ○ | ○ |
| 621 | 67.80 | 0.005 | 0.05 | 1.25 | 28.63 | 0.55 | 0.02 | 0.03 | 0.75 | 0.90 | 0.005 | 0.0015 | 0.005 | 0.0025 | 39.4 | ○ | ○ |
| 622 | 66.20 | 0.005 | 0.05 | 1.25 | 30.73 | 0.55 | 0.02 | 0.03 | 0.25 | 0.90 | 0.005 | 0.0015 | 0.005 | 0.0025 | 39.4 | ○ | ○ |
| 623 | 65.90 | 0.005 | 0.05 | 1.25 | 30.98 | 0.55 | 0.02 | 0.03 | 0.50 | 0.70 | 0.005 | 0.0015 | 0.005 | 0.0025 | 39.4 | ○ | ○ |
| 624 | 67.30 | 0.005 | 0.05 | 1.25 | 29.28 | 0.35 | 0.02 | 0.03 | 1.00 | 0.70 | 0.005 | 0.0015 | 0.005 | 0.0025 | 39.4 | ○ | ○ |
| 625 | 67.30 | 0.005 | 0.05 | 0.20 | 30.43 | 0.55 | 0.02 | 0.03 | 0.50 | 0.90 | 0.005 | 0.0015 | 0.005 | 0.0025 | 39.4 | ○ | ○ |
| 626 | 67.60 | 0.005 | 0.05 | 0.20 | 30.03 | 0.35 | 0.02 | 0.03 | 1.00 | 0.70 | 0.005 | 0.0015 | 0.005 | 0.0025 | 39.4 | ○ | ○ |
| 627 | 67.10 | 0.005 | 0.05 | 0.20 | 30.83 | 0.35 | 0.02 | 0.03 | 0.50 | 0.90 | 0.005 | 0.0015 | 0.005 | 0.0025 | 39.4 | ○ | ○ |
| 628 | 65.90 | 0.005 | 0.05 | 0.20 | 31.53 | 0.55 | 0.02 | 0.03 | 1.00 | 0.70 | 0.005 | 0.0015 | 0.005 | 0.0025 | 41.0 | ○ | ○ |
| 629 | 67.30 | 0.005 | 0.05 | 0.10 | 30.53 | 0.55 | 0.02 | 0.03 | 0.50 | 0.90 | 0.005 | 0.0015 | 0.005 | 0.0025 | 39.4 | ○ | ○ |
| 630 | 67.60 | 0.005 | 0.05 | 0.10 | 30.13 | 0.35 | 0.02 | 0.03 | 1.00 | 0.70 | 0.005 | 0.0015 | 0.005 | 0.0025 | 39.4 | ○ | ○ |
| 631 | 67.20 | 0.005 | 0.05 | 0.10 | 30.83 | 0.35 | 0.02 | 0.03 | 0.50 | 0.90 | 0.005 | 0.0015 | 0.005 | 0.0025 | 39.4 | ○ | ○ |
| 632 | 65.90 | 0.005 | 0.05 | 0.10 | 31.63 | 0.55 | 0.02 | 0.03 | 1.00 | 0.70 | 0.005 | 0.0015 | 0.005 | 0.0025 | 41.0 | ○ | ○ |
| 633 | 67.30 | 0.005 | 0.10 | 0.10 | 30.48 | 0.55 | 0.02 | 0.03 | 0.50 | 0.90 | 0.005 | 0.0015 | 0.005 | 0.0025 | 39.4 | ○ | ○ |
| 634 | 66.90 | 0.005 | 0.10 | 0.10 | 31.58 | 0.55 | 0.02 | 0.03 | 1.00 | 0.70 | 0.005 | 0.0015 | 0.005 | 0.0025 | 41.0 | ○ | ○ |

What is claimed is:

1. A brass consisting of:

Cu: not less than 55% by mass to not more than 75% by mass,

Si: not less than 0.01% by mass to not more than 1.5% by mass,

Pb: 0.01% by weight to 4.0% by weight,

B: 0.0001% by weight to 0.3% by weight,

Sn and Al: amounts which meet the following relations,

Mn as an optional ingredient: less than 0.25% by mass,

Ni: >0 and not more than 0.7% by mass,

Ti as an optional ingredient: less than 0.05% by mass,

Mg as an optional ingredient: less than 0.3% by mass,

P as an optional ingredient: less than 0.15% by mass, optional ingredients selected from the group consisting of Sb, As, Se, Te, Fe, Co, Zr and Cr, each utilized in an amount from 0.01 to 2.0% by mass, when present, a rare earth metal as an optional ingredient: less than 0.004% by mass, and the balance of Zn and unavoidable impurities, the brass having an apparent Zn content of not less than 37 and not more than 45, wherein (I) when the content of Si is not less than 0.01% by mass and not more than 0.1% by mass, (1) the apparent Zn content is not less than 37 and less than 39 and the following relationship is satisfied:

$$0.1 \le x \le 0.2 \text{ and } 0.1 < y \le 2.0 \text{ or} \quad (1\text{-}1)$$

$$0.2 < x \le 3.0 \text{ and } 0.1 \le y \le 2.0 \quad (1\text{-}2)$$

wherein x represents the content of Sn, % by mass; and y represents the content of Al, % by mass, (2) the apparent Zn content is not less than 39 and less than 43 and the following relationship is satisfied:

$$0.1 < x \le 0.2 \text{ and } -4x+0.9 < y \le 2.0 \text{ or} \quad (2\text{-}1)$$

$$0.2 < x \le 3.0 \text{ and } 0.1 \le y \le 2.0 \quad (2\text{-}2)$$

wherein x represents the content of Sn, % by mass; and y represents the content of Al, % by mass, and (3) the apparent Zn content is not less than 43 and not more than 45 and the following relationship is satisfied:

$$0.1 \le x \le 0.2 \text{ and } 0.5 < y \le 2.0, \quad (3\text{-}1)$$

$$0.2 < x \le 0.3 \text{ and } -4x+1.3 < y \le 2.0, \text{ or} \quad (3\text{-}2)$$

$$0.3 < x \le 3.0 \text{ and } 0.1 \le y \le 2.0 \quad (3\text{-}3)$$

wherein x represents the content of Sn, % by mass; and y represents the content of Al, % by mass, (II) when the content of Si is more than 0.1% by mass and not more than 0.5% by mass, (4) the apparent Zn content is not less than 37 and less than 39 and the following relationship is satisfied:

$$0.1 \le x \le 0.2 \text{ and } -5x+1.5 < y \le 2.0 \text{or} \quad (4\text{-}1)$$

$$0.2 < x \le 3.0 \text{ and } 0.1 \le y \le 2.0 \quad (4\text{-}2)$$

wherein x represents the content of Sn, % by mass; and y represents the content of Al, % by mass, (5) the apparent Zn content is not less than 39 to less than 41 and the following relationship is satisfied:

$$0.1 < x \le 0.2 \text{ and } -5x+1.5 < y \le 2.0 \text{ or} \quad (5\text{-}1)$$

$$0.2 < x \le 3.0 \text{ and } 0.1 \le y \le 2.0 \quad (5\text{-}2)$$

wherein x represents the content of Sn, % by mass; and y represents the content of Al, % by mass, (6) the apparent Zn content is not less than 41 to less than 43 and the following relationship is satisfied:

$$0.1 < x \le 0.2 \text{ and } -5x+2.5 < y \le 2.0, \quad (6\text{-}1)$$

$$0.2 < x \le 0.3 \text{ and } -4x+1.3 < y \le 2.0, \quad (6\text{-}2)$$

$$0.3 < x \le 0.4 \text{ and } 0.1 < y \le 2.0 \text{ or} \quad (6\text{-}3)$$

$$0.3 < x \le 0.4 \text{ and } 0.1 \le y \le 2.0 \quad (6\text{-}4)$$

wherein x represents the content of Sn, % by mass; and y represents the content of Al, % by mass, and (7) the apparent Zn content is not less than 43 and not more than 45 and the following relationship is satisfied:

$$0.3 < x \le 0.4 \text{ and } -5x+2.5 < y \le 2.0, \quad (7\text{-}1)$$

$$0.4 < x \le 0.5 \text{ and } -4x+2.1 < y \le 2.0 \text{ or} \quad (7\text{-}2)$$

$$0.5 < x \le 3.0 \text{ and } 0.1 \le y \le 2.0 \quad (7\text{-}3)$$

wherein x represents the content of Sn, % by mass; and y represents the content of Al, % by mass, (III) when the content of Si is more than 0.5% by mass and not more than 1.0% by mass, (8) the apparent Zn content is not less than 37 and less than 39 and the following relationship is satisfied:

$$0.1 < x \le 0.2 \text{ and } -4x+0.9 < y \le 2.0 \text{ or} \quad (8\text{-}1)$$

$$0.2 < x \le 3.0 \text{ and } 0.1 \le y \le 2.0 \quad (8\text{-}2)$$

wherein x represents the content of Sn, % by mass; and y represents the content of Al, % by mass, (9) the apparent Zn content is not less than 39 and less than 41 and the following relationship is satisfied:

$$0.1 < x \le 0.2 \text{ and } -5x+2.0 < y \le 2.0, \quad (9\text{-}1)$$

$$0.2 < x \le 0.3 \text{ and } -4x+1.3 < y \le 2.0, \quad (9\text{-}2)$$

$$0.3 < x \le 0.4 \text{ and } 0.1 < y \le 2.0 \text{ or} \quad (9\text{-}3)$$

$$0.4 < x \le 3.0 \text{ and } 0.1 < y \le 2.0 \quad (9\text{-}4)$$

wherein x represents the content of Sn, % by mass; and y represents the content of Al, % by mass,

(10) the apparent Zn content is not less than 41 and less than 43 and the following relationship is satisfied:

$$0.2 < x \le 0.3 \text{ and } -5x+2.5 < y \le 2.0, \quad (10\text{-}1)$$

$$0.3 < x \le 0.4 \text{ and } -4x+1.7 < y \le 2.0 \text{ or} \quad (10\text{-}2)$$

$$0.4 < x \le 3.0 \text{ and } 0.1 \le y \le 2.0 \quad (10\text{-}3)$$

wherein x represents the content of Sn, % by mass; and y represents the content of Al, % by mass, and

(11) the apparent Zn content is not less than 43 and not more than 45 and the following relationship is satisfied:

$$0.3 < x \le 0.4 \text{ and } -5x+3.0 < y \le 2.0 \text{ or} \quad (11\text{-}1)$$

$$0.4 < x \le 3.0 \text{ and } 0.1 \le y \le 2.0 \quad (11\text{-}2)$$

wherein x represents the content of Sn, % by mass; and y represents the content of Al, % by mass, and (IV) when the content of Si is more than 1.0% by mass and not more than 1.5% by mass,

(12) the apparent Zn content is not less than 37 and less than 39 and the following relationship is satisfied:

$$0.1 \le x \le 0.2 \text{ and } -4x+0.9 < y \le 2.0, \quad (12\text{-}1)$$

$$0.2 < x \le 0.3 \text{ and } 0.1 < y \le 2.0 \text{ or} \quad (12\text{-}2)$$

$$0.3 < x \le 3.0 \text{ and } 0.1 \le y \le 2.0 \quad (12\text{-}3)$$

wherein x represents the content of Sn, % by mass; and y represents the content of Al, % by mass,

(13) the apparent Zn content is not less than 39 and less than 41 and the following relationship is satisfied:

$$0.1<x\leq 0.2 \text{ and } -5x+2.0<y\leq 2.0, \quad (13\text{-}1)$$

$$0.2<x\leq 0.3 \text{ and } 1.0<y\leq 2.0 \text{ or} \quad (13\text{-}2)$$

$$0.3<x\leq 3.0 \text{ and } 0.1\leq y\leq 2.0 \quad (13\text{-}3)$$

wherein x represents the content of Sn, % by mass; and y represents the content of Al, % by mass,

(14) the apparent Zn content is not less than 41 and less than 43 and the following relationship is satisfied:

$$0.4<x\leq 0.5 \text{ and } -5x+3.0<y\leq 2.0 \text{ or} \quad (14\text{-}1)$$

$$0.5<x\leq 3.0 \text{ and } 0.1\leq y\leq 2.0 \quad (14\text{-}2)$$

wherein x represents the content of Sn, % by mass; and y represents the content of Al, % by mass, and

(15) the apparent Zn content is not less than 43 and not more than 45, the following relationship is satisfied:

$$0.2<x\leq 0.3 \text{ and } -5x+2.5<y\leq 2.0, \quad (15\text{-}1)$$

$$0.3<x\leq 0.4 \text{ and } -4x+1.7<y\leq 2.0 \text{ or} \quad (15\text{-}2)$$

$$0.4<x\leq 3.0 \text{ and } 0.1\leq y\leq 2.0 \quad (15\text{-}3)$$

wherein x represents the content of Sn, % by mass; and y represents the content of Al, % by mass.

2. The brass according to claim 1, which has not undergone heat treatment for eliminating or reducing a β phase.

3. The brass according to claim 1, which contains 0.01% by weight to 2% by mass of at least one element selected from the group consisting of Sb, As, Se, Te, Fe, Co, Zr, and Cr.

4. The brass according to claim 1, which contains not more than 0.2% by mass of at least one element selected from the group consisting of Sb and As.

5. The brass according to claim 1, which contains not more than 1% by mass of Se or Te.

6. The brass according to claim 1, which contains not more than 1% by mass of Fe or Co.

7. The brass according to claim 1, which contains not more than 0.5% by mass of Zr and Cr.

8. A brass material comprising a brass according to claim 1.

9. A faucet metal fitting comprising a brass according to claim 1.

10. A faucet metal fitting according to claim 9, produced by casting.

* * * * *